US005971525A

United States Patent [19]

Inoue et al.

[11] Patent Number: 5,971,525

[45] Date of Patent: Oct. 26, 1999

[54] RECORDING APPARATUS HAVING A DEELECTRIFYING MEMBER FOR A RECORDING HEAD

[75] Inventors: Hiroyuki Inoue; Akira Miyakawa, both of Yokohama; Soichi Hiramatsu, Hachioji; Hideki Yamaguchi; Kenji Kawazoe, both of Yokohama; Takashi Nojima, Tokyo; Tetsuya Ishikawa, Yokohama; Hitoshi Nakamura, Kawasaki; Akira Kida; Hideaki Kawakami, both of Yokohama; Haruyuki Yanagi, Machida; Tetsuo Suzuki, Yokohama, all of Japan

[73] Assignee: Canon Kabushiki Kaisha, Tokyo, Japan

[21] Appl. No.: 08/992,211

[22] Filed: Dec. 16, 1997

Related U.S. Application Data

[63] Continuation of application No. 08/301,027, Sep. 6, 1994, abandoned.

[30] Foreign Application Priority Data

| | | | |
|---|---|---|---|
| Sep. 8, 1993 | [JP] | Japan | 5-223684 |
| Aug. 4, 1994 | [JP] | Japan | 6-183398 |
| Aug. 24, 1994 | [JP] | Japan | 6-204013 |

[51] Int. Cl.[6] ..... B41J 2/14; B41J 2/16

[52] U.S. Cl. ..... 347/50

[58] Field of Search ..... 347/50; 361/212, 361/220; 248/60, 63, 74.1, 74.3; 174/35 R, 51, 69, DIG. 9; 439/95, 97, 108, 109, 449, 497, 609, 610

[56] References Cited

U.S. PATENT DOCUMENTS

| | | | |
|---|---|---|---|
| 3,916,421 | 10/1975 | Hertz | 347/73 |
| 4,130,334 | 12/1978 | Anderson | 439/497 |
| 4,712,172 | 12/1987 | Kiyohara et al. | 347/60 |
| 4,907,018 | 3/1990 | Pinkerpell et al. | 347/50 |
| 5,162,818 | 11/1992 | Karita et al. | 347/50 |
| 5,467,116 | 11/1995 | Nakamura et al. | 347/50 |

FOREIGN PATENT DOCUMENTS

| | | |
|---|---|---|
| 0 372 997 | 6/1990 | European Pat. Off. . |
| 59-103781 | 6/1984 | Japan . |
| WO 94/16896 | 8/1994 | WIPO . |

OTHER PUBLICATIONS

IBM Technical Disclosure Bulletin, "Static Electrical Charge Grounding in a Printer with Plastic Parts", vol. 28, No. 7, pp. 2799–2800, Dec. 1985.

*Primary Examiner*—N. Le
*Assistant Examiner*—L. Anderson
*Attorney, Agent, or Firm*—Fitzpatrick, Cella, Harper & Scinto

[57] ABSTRACT

A recording apparatus comprises a head for forming an image on a recording medium or for reading an image formed on a recording medium; a supporting member for holding the head; a first unit for electrical connection provided for the head; a second unit for electrical connection provided for the supporting member, which can be electrically connected to the first unit for electrical connection; and a member for deelectrifying static electricity, which is provided for the supporting member in the vicinity of the second unit for electrical connection. This deelectrifying member prevents static electricity from flowing into the signal lines provided for the second unit for electrical connection when the supporting member is actuated to hold the head.

35 Claims, 20 Drawing Sheets

RECORDING APPARATUS HAVING A DEELECTRIFYING MEMBER FOR A RECORDING HEAD

This application is a continuation of application Ser. No. 08/301,027 filed Sep. 6, 1994, abandoned.

BACKGROUND OF THE INVENTION

1. Field of the Invention

The present invention relates to a recording apparatus which uses a recording head for forming an image on a recording medium or a reading head for reading an image formed on a recording medium.

2. Related Background Art

There has been a problem that a recording head, a reading head, or an electric circuit in the main body of the apparatus is damaged due to the static electricity accumulated on the hand of an operator when the operator places his hand on or touches the recording head, the reading head, or the vicinity thereof. There has also been a problem of the same kind due to the static electricity accumulated on a part of the operator's body or on the aforesaid head when the operator attaches or detaches the recording head or reading head to or from a supporting member which holds the head.

For example, an exchangeable recording head integrally formed with an ink tank for a recording apparatus of an ink jet type often exposes the portion where the recording head is coupled with the signal lines drawn from the main body of the apparatus on the occasion that such recording heads are to be exchanged. Despite the existence of this exposed coupling portion, the operator's hand inevitably approaches this portion when the recording heads are exchanged. As means for preventing this, there has been often provided a cover over this coupling portion so that the operator's hand does not touch the portion to be exposed for coupling.

However, the provision of this cover results in the increased number of parts, and disadvantageously raises the cost. In addition, although the number of parts does not increase considerably if the cover is structured so that it can be simply fixed, such a fixed type cover should be provided with the so-called shutter arrangement so that while the exposed portion is covered when the head is removed, the external cover member can be retracted in order to execute the required coupling when the head is mounted. In this case, the number of parts inevitably increases more, and the structure becomes more complicated. This is disadvantageous not only costwise, but also, in the maintenance of good quality of the product.

SUMMARY OF THE INVENTION

It is an object of the present invention to solve the above-mentioned technical problems and provide a highly reliable recording apparatus capable of preventing any damage from taking place on the electric circuit and others due to the static electricity.

It is another object of the present invention to provide a highly reliable recording apparatus capable of avoiding any adverse effect that may be produced on the electric circuit and others by efficiently applying deelectrification of static electricity efficiently by use of a deelectrifying member.

It is still another object of the present invention to provide a highly reliable recording apparatus comprising the following:

a head for forming an image on a recording medium or for reading an image formed on a recording medium;

a supporting member for holding the head;

a first unit for electrical connection provided for the head;

a second unit for electrical connection provided for the supporting member, which can be electrically connected to the first unit for electrical connection; and a member for deelectrifying static electricity, which is provided for the supporting member in the vicinity of the second unit for electrical connection.

This deelectrifying member prevents static electricity from flowing into the signal lines provided for the second unit for electrical connection when the supporting member is actuated to hold the head.

BRIEF DESCRIPTION OF THE DRAWINGS

FIG. 18A, a plan view; and FIG. 18B, a front view.

FIG. 19A, an enlargement of the fitting pin 505*b* in FIG. 7; and FIG. 19B, an enlargement of the fitting pin 505*a* in FIG. 7.

FIG. 20A, a state where the leading portion 562 is assembled; FIG. 20B and FIG. 20C, views illustrating the process in which the leading portion is inserted.

FIG. 23A, a state before setting; FIG. 23B, in the process of setting; and FIG. 23C, after setting, respectively.

DETAILED DESCRIPTION OF THE PREFERRED EMBODIMENTS

Hereinafter with reference to the accompanying drawings, the detailed description will be made of the embodiments of a recording apparatus according to the present invention, in which a deelectrifying unit is provided for deelectrifying the static electricity which produces an adverse effect on the recording apparatus when an operation is executed for attaching or detaching the recording head.

First Embodiment

Figure 1:
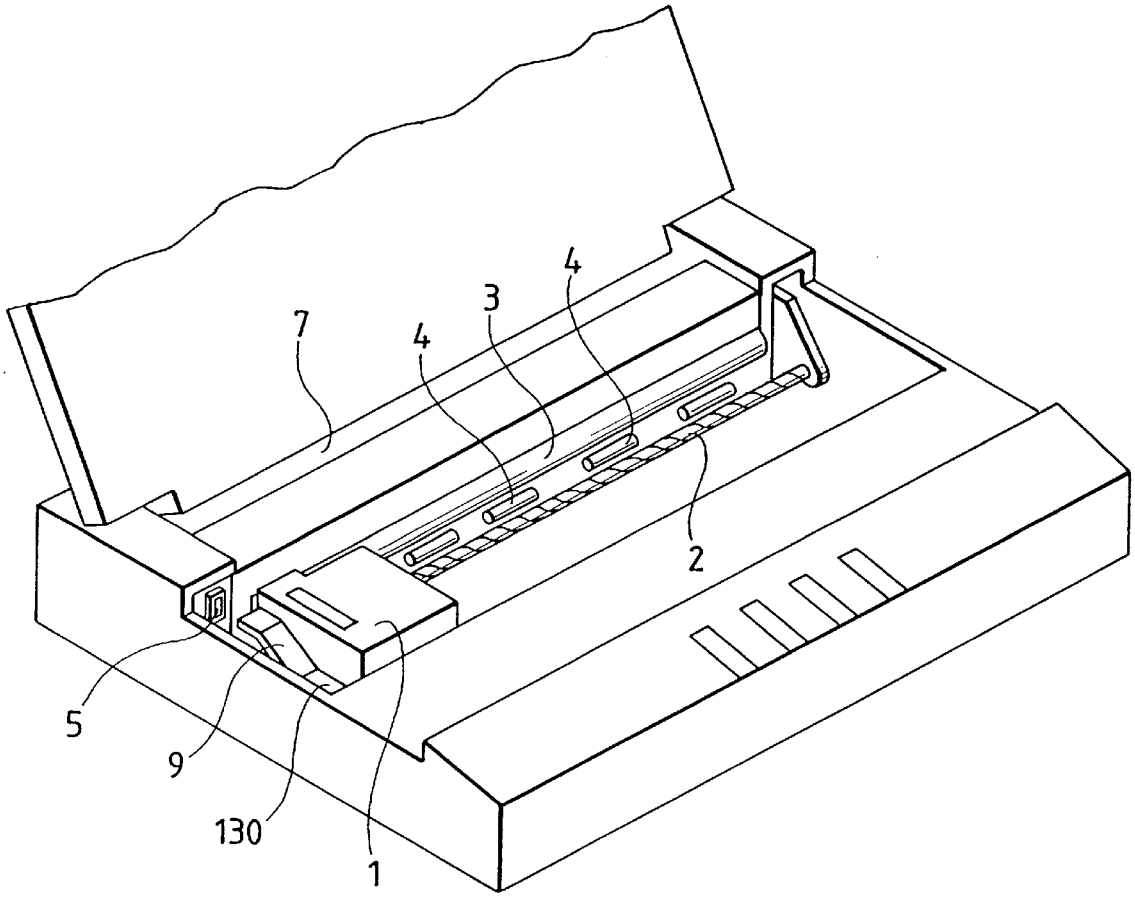
FIG. 1 is a perspective view schematically showing a first embodiment according to the present invention.

FIG. 1 is a perspective view schematically showing a first embodiment of a recording apparatus according to the present invention.

At first, using a recording apparatus the entire structure of which is schematically shown in a perspective view in FIG. 1, the description will be made of the first embodiment capable of deelectrifying the static electricity charged through the operator's finger, hand, or other part of body when attaching or detaching the recording head.

In FIG. 1, a reference numeral 1 designates an ink cartridge formed by integrating a recording head and an ink tank: the cartridge 1 is an exchangeable head detachably mountable on a carriage; and 9, a lever for fixing the head, whereby to fix the cartridge 1 to the carriage when the cartridge 1 is mounted on the carriage. In FIG. 1, the fixing lever 9 is pressed down. In this state, the cartridge 1 is fixed to the carriage. When the fixing lever 9 is pulled up, the cartridge can be removed from the carriage. The recording head in the cartridge 1 will be described later.

A reference numeral 2 designates a lead screw whereby the carriage travels in the left- and right-hand directions. The carriage fits in the groove of the lead screw 2. By the rotation of the lead screw, the carriage reciprocates in the longitudinal direction of the lead screw 2.

A sheet is inserted from a sheet inlet 7 into the recording apparatus as a recording medium.

A reference numeral 3 designates a sheet feed roller. In a position facing the feed roller 3, a pinch roller 4 is arranged. Between the sheet feed roller 3 and the pinch roller 4 pressed to it, the sheet is held while being fed. In this way, the sheet is conveyed. A reference numeral 5 designates a cap to cover the recording head 1 so that its nozzles are not dried on standby.

Figure 2:
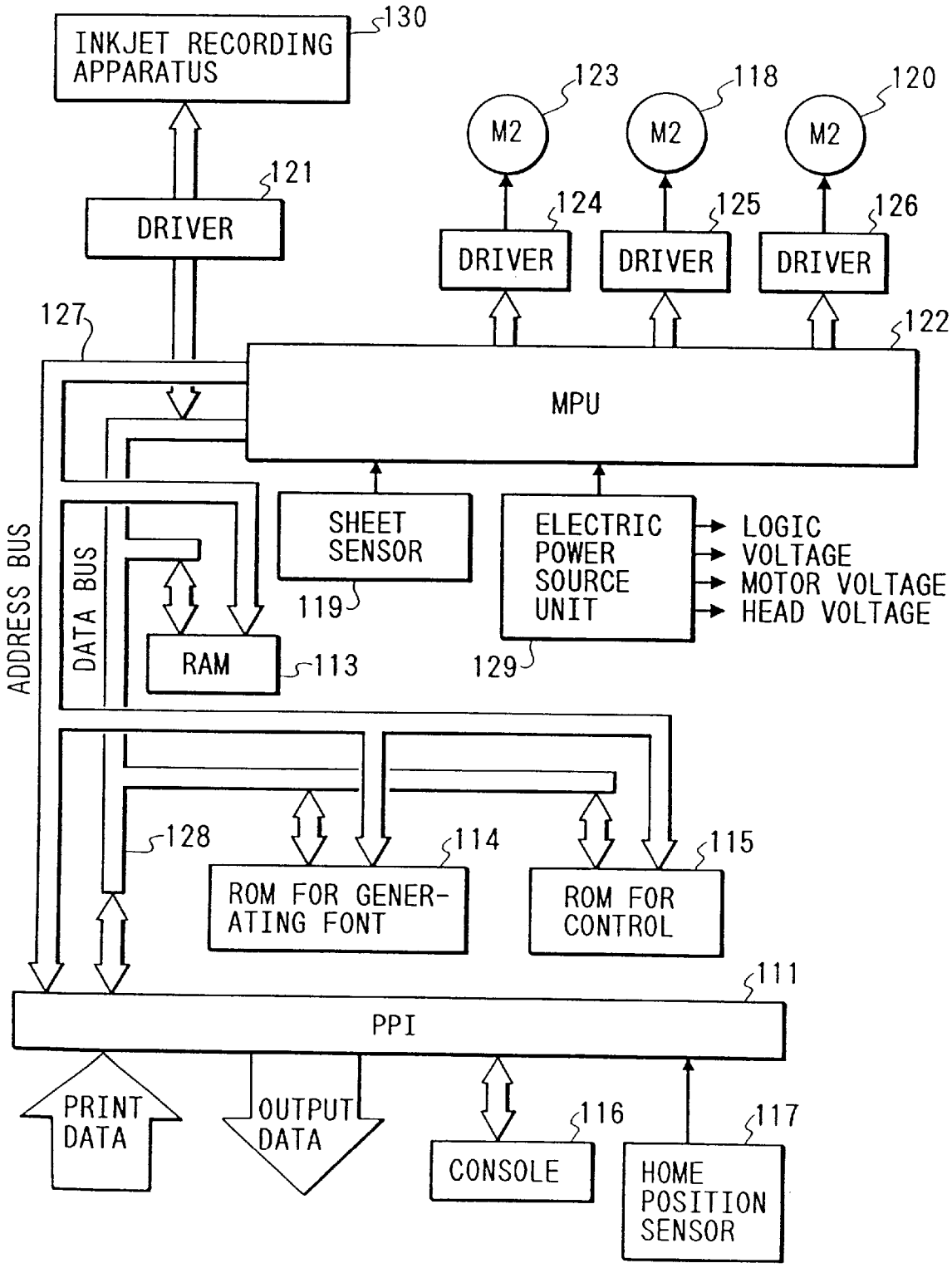
FIG. 2 is a block diagram showing the structure of controlling system for a recording apparatus represented in FIG. 1.

Now, FIG. 2 is a block diagram showing the structure of the controlling system of the recording apparatus represented in FIG. 1. In FIG. 2, a programmable peripheral interface (hereinafter referred to as PPI) 111 transfers instruction signals (commands) and recording information signals transmitted from the host computer to a MPU (microprocessing unit) 122 as these are being received in parallel, and at the same time, executes the input processes for controlling a console 116 and a carriage home position sensor 117.

The MPU 122 controls each unit in the recording apparatus. Here, a RAM 113 accumulates the received signals. A ROM 114 for generating fonts outputs images such as characters and signs. A controlling ROM 115 stores the process procedures to be executed by the MPU 112. Each of these units is controlled by the MPU 122 through an address bus 127 and a data bus 128, respectively.

A reference numeral 118 designates a carriage motor for enabling the carriage to travel; 120, sheet feeding motor for conveying the sheet in the direction perpendicular to the traveling direction of the carriage 2; 123, a capping motor for driving a cap member (not shown) to abut on the ink discharge ports (not shown) of the recording head 1 so that the ink discharge ports are shut off from the air outside.

Also, a reference numeral 125 designates a driver for the carriage motor 118; 126, a driver for the sheet feeding motor 120; 124, a driver for the capping motor 123. The above-mentioned console 116 is-provided with key board switches, indication lamps, and others, but these are not shown in FIG. 2.

The home position sensor 117 is arranged in the vicinity of a given home position of the carriage, and detects optically, for example, that the carriage 2 having the recording head 1 mounted on it has arrived at the home position. A sheet sensor 119 detects the presence or absence of the sheet such as a recording sheet, that is, detects whether or not the sheet is supplied to a given position of the recording portion lustrously, for example.

A reference numeral 130 designates a ink jet recording head of a type to discharge ink by utilizing heat energy: for this recording head 130, discharge ports (not shown), heaters for discharging (electrothermal transducers) (not shown), and others are provided; and 121, a driver which drives the heaters for discharging of the recording head 130 in accordance with the recording information signals. Also, the ink jet recording head 130 is integrally formed with an ink tank as described earlier.

A reference numeral 129 designates a power-supply for each of the above-mentioned units. As means for supplying driving power, an AC adaptor and cells are provided.

In the structure as described above, the MPU 122 is connected to a host apparatus such as a computer through the PPI 111, and controls the recording operation in accordance with the commands and recording information signals transmitted from the host apparatus, and the stored program in the controlling ROM 115 for process procedures as well as the recording information accumulated in the RAM 113.

The First Example of the Embodiment

Figure 3:
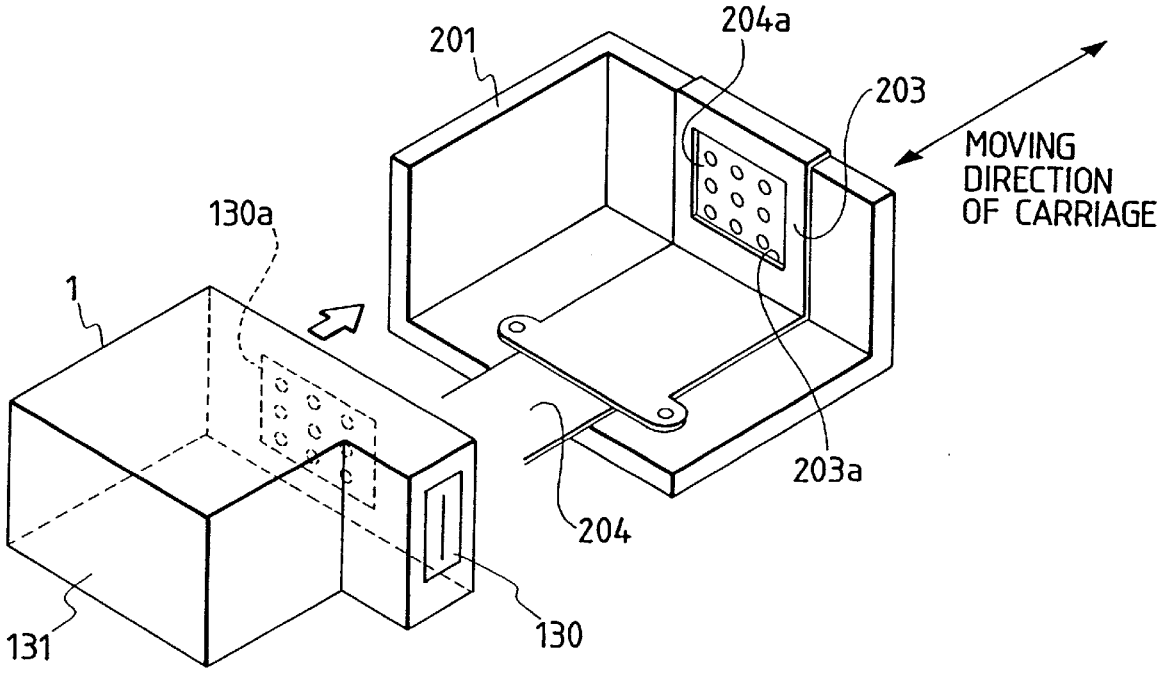
FIG. 3 is a perspective view schematically showing the principal part of the first example of the embodiment.

FIG. 3 relates to the first embodiment according to the present invention, and is a perspective view showing the connection between the recording head and the carriage of the recording apparatus represented in FIG. 1. In FIG. 3, the ink cartridge 1 is formed integrally by a head 130 and an ink tank 131. The cartridge 1 is detachable with respect to the carriage 201, that is, this head is exchangeable. Here, a reference numeral 130*a* designates a head terminal for electrically connecting the signal lines through which the signal and power are supplied for driving the recording head 130. In the head terminal 130*a,* exposed conductors are formed in a given number.

The carriage 201 mounts the cartridge 1 on it, and scans in the left- and right hand directions by means of a motor (not shown). The cartridge 1 is fixed to the carriage 201 by means of a lever and others (not shown). A reference numeral 204*a* designates a terminal formed on the cable 204, having exposed conductors corresponding to the exposed conductors of the head terminal 130*a:* the recording head 202 is fixed to the carriage 201 in the direction indicated by an arrow in FIG. 3, and at this juncture, the head terminal 130*a* and the cable terminal 204*a* abut upon each other by biasing means (not shown) in order to make the electrical connection; and 203, a pressure board for cable functioning as a deelectrifying member, which is a metallic member for fixing the cable 204 to the carriage 201. The pressure board 203 for cable is a plate having an almost L-letter cross-section, and positions the cable terminal 204*a* so that it is reliably connected to the head terminal 130*a.* This member also modifies any deviation of the direction in which the cable is drawn. On the pressure board 203, a window 203*a* is formed. Through this window 203*a,* the cable terminal 204*a* is exposed to the cartridge 1.

Figure 4:
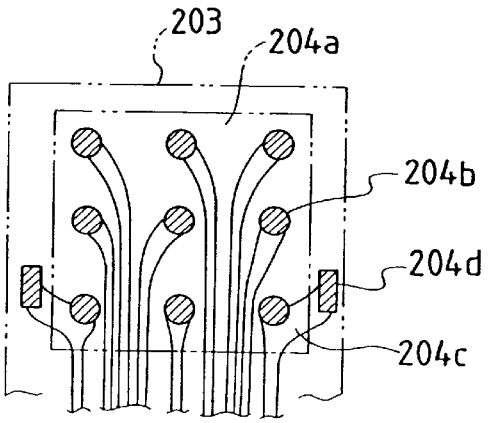
FIG. 4 a plan view schematically showing the principal part of a device represented in FIG. 3.

FIG. 4 illustrates the cable terminal 204*a* in detail. Here, a reference numeral 204*b* designates the exposed conductors which are usually gold plated; 204*c,* a pattern formed by the conductors, the portions other than the exposed conductors 204*b* being covered by a cover: the pressure board 203 for cable is indicated by dashed line; and 204*d,* the exposed conductors having a wiring pattern for grounding (hereinafter referred to as GND pattern). The pressure board 203 for cable is made of a metal such as stainless steel according to the present embodiment, and is in contact with the GND pattern 204*d.* In other words, the pressure board 203 for cable is grounded through the GND pattern of the cable.

Here, when the operator allows his hand to approach the cable terminal 204*a* for exchanging the recording heads 202 in the conventional structure where no metallic portion is provided for grounding unlike the present invention, the static electricity is discharged from his hand to the cable terminal if his hand is electrostatically charged. In this case, a problem is encountered that any elements which are easily damaged by static electricity are broken if such elements exist in the location connected to the pattern which receives the discharged static electricity. In the structure embodying the present invention, the grounded metallic portion (pressure board 203 for cable 204) is arranged in the vicinity of the cable terminal 204*a.* Therefore, any static electricity charged to the operator's hand is discharged to the pressure board 203 for cable so that the breakage of such elements can be prevented.

In this way, it is possible to provide a recording apparatus capable of preventing the elements from being damaged by static electricity without increasing the number of parts that may result in the cost increase by grounding the member for pressing cable through the GND pattern.

The Second Example of the Embodiment

Figure 5:
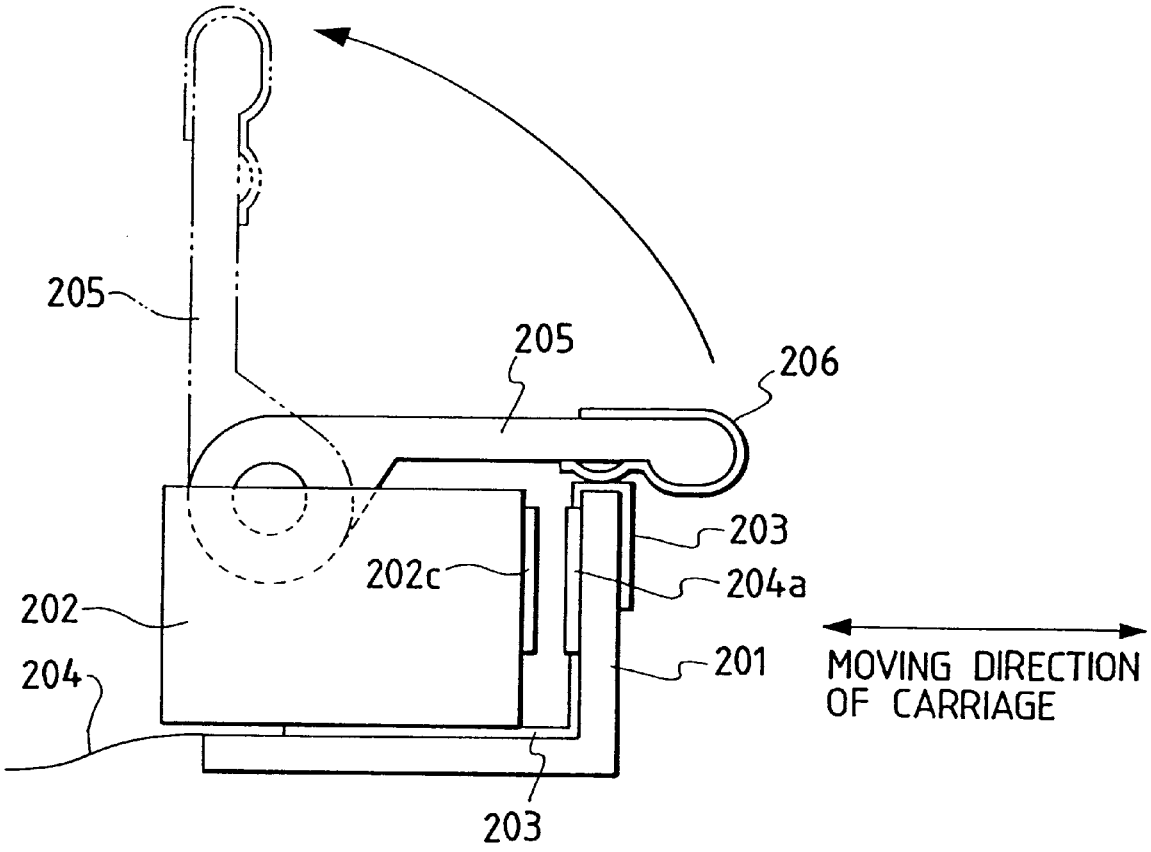
FIG. 5 is a side view schematically showing the second example of the embodiment according to the present invention.

FIG. 5 is a side view showing the principal part of an example of a second embodiment according to the present invention. In FIG. 5, a reference numeral 205 designates a lever for installing the recording head. When the cartridge 1 is fixed to the carriage 201, the elongated part of the lever is placed horizontally. When the cartridge 1 is removed, the lever 205 rotates in the direction indicated by an arrow in FIG. 5 to place the elongated part of the lever vertically. According to the present embodiment, the leading end of the lever 205, that is, where the operator's hand touches, is provided with a cover 206 made of a conductor such as a flat metal. This cover is structured to contact the pressure board 203 for cable when the recording head 202 is set in the carriage 201. In other words, in the operation of the lever which is the first operation to be conducted by the operator in exchanging the recording heads, the static electricity charged to his hand is discharged to this lever, and is, in turn, allowed to escape to the GND from the pressure board 203 for cable through the GND pattern of the cable.

With the structure arranged such as this, not only it is possible to obtain the same effect as the first example of the embodiment, but also, to avoid any danger that may exist in destroying the recording head elements due to the discharge of the static electricity to the terminal 202*c* of the recording head 202 because it is discharged before the operator's hand touches the recording head 202.

The Third Example of the Embodiment

Figure 6:
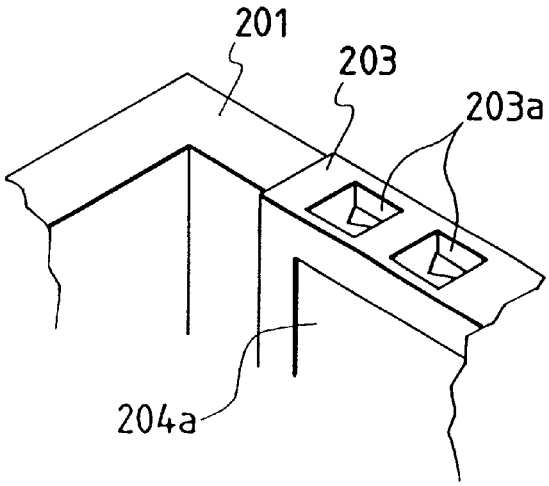
FIG. 6 is a perspective view schematically showing the principal part of the third example of the embodiment according to the present invention.

FIG. 6 is a perspective view showing the principal part of the third example of the embodiment according to the present invention. The example of the present embodiment is such that a deelectrifying member such as the pressure board for cable is configured to make it easier to discharge the static electricity. By the utilization of the fundamental properties of static electricity that it is more easily discharged to the leading end of a sharp configuration, a part of the pressure board 203 for cable is folded inwardly to make it an edged form. In this case, the leading end of the edge is formed in a slightly deepened recess so as not allow the operator's hand to touch it and injure his hand. With this configuration, it is possible to obtain the deelectrifying effect more reliably without increasing the number of parts. Therefore, this measure can be implemented by the formation of an inexpensive structure.

The Fourth Example of the Embodiment

Figure 8:
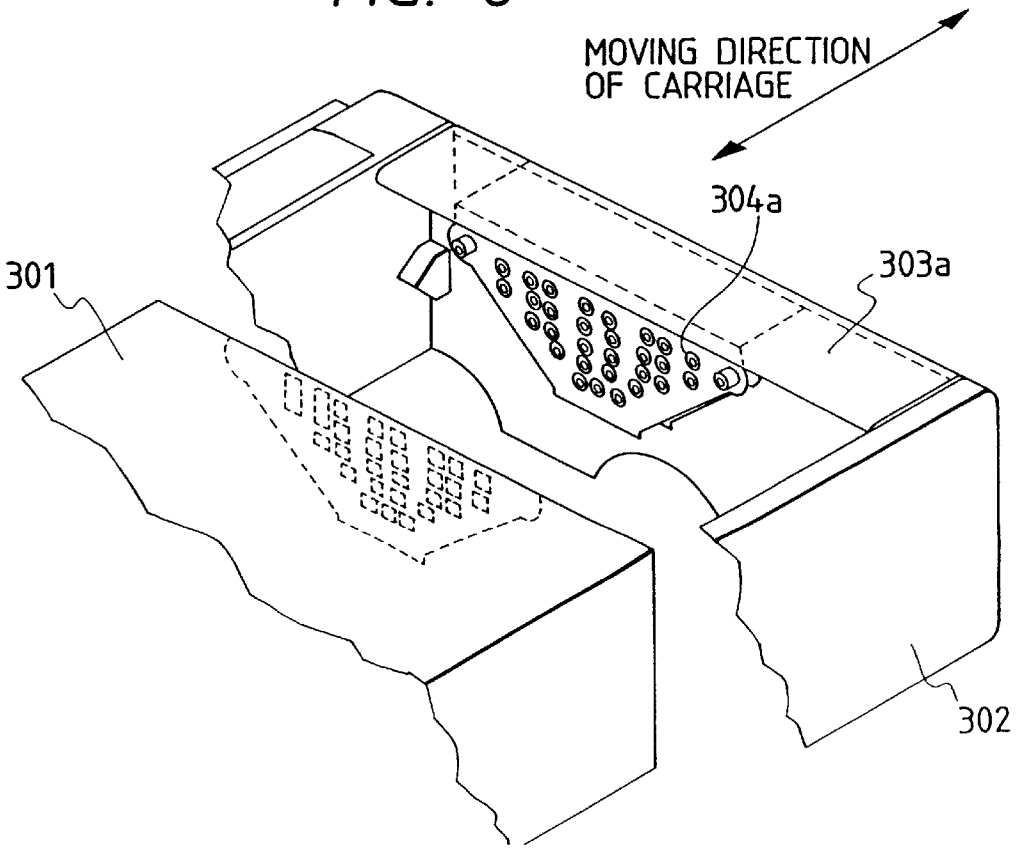
FIG. 8 is a perspective view schematically showing the principal part of a device represented in FIG. 7.
Figure 9:
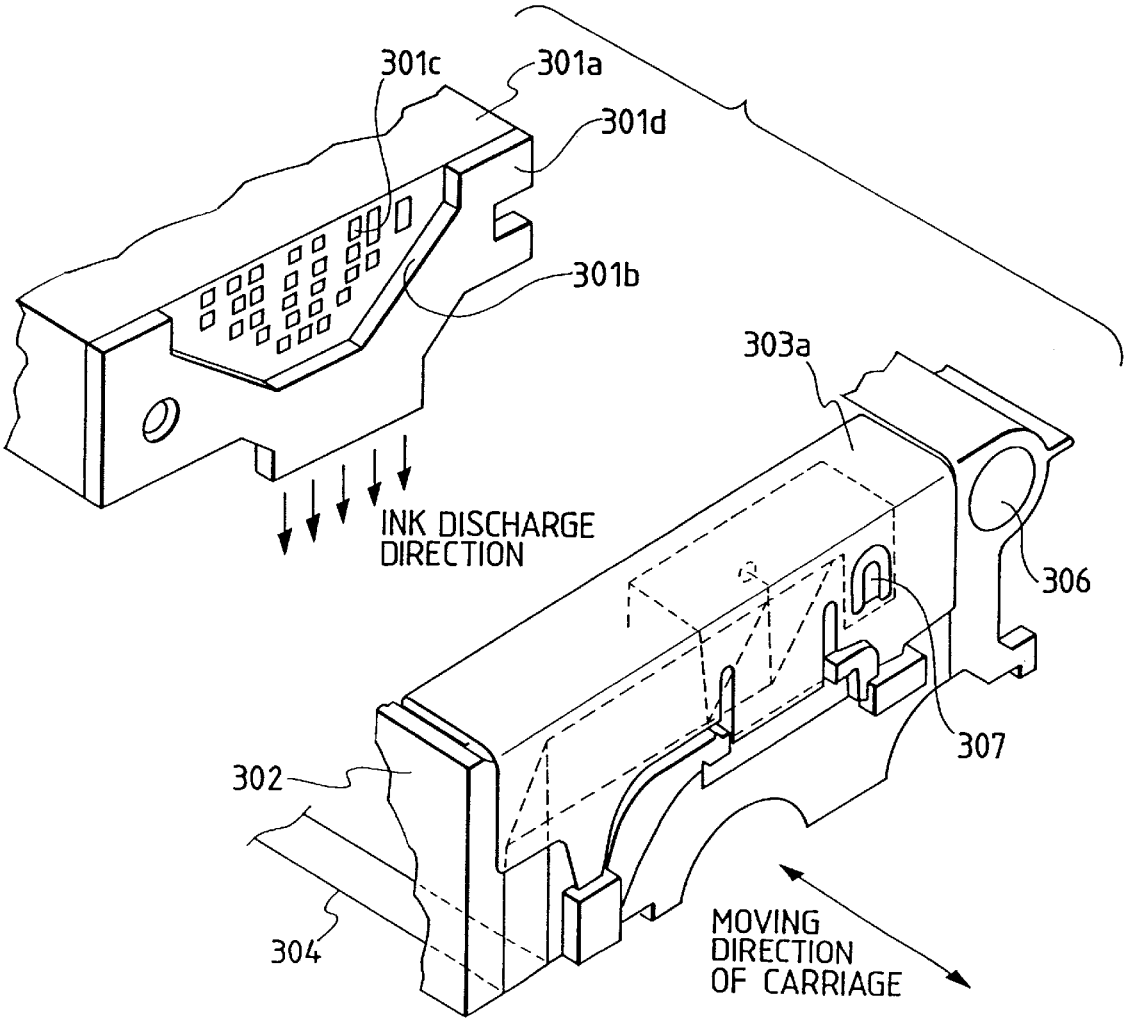
FIG. 9 is another perspective view schematically showing the principal part of the device represented in FIG. 7.

Now, in conjunction with FIG. 7 to FIG. 9, the description will be made of the fourth example of the embodiment according to the present invention.

Figure 7:
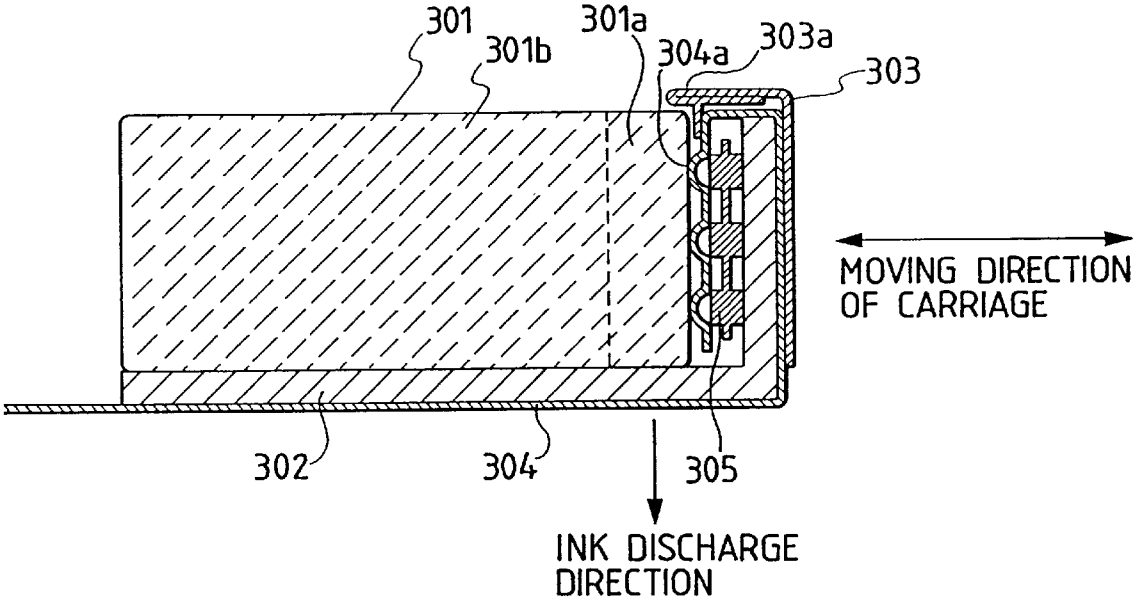
FIG. 7 is a cross-sectional view schematically showing the principal part of the fourth example of the embodiment according to the present invention.

FIG. 7 is a cross-sectional view schematically showing a state where the head cartridge 301 is mounted on the carriage 302 along the direction in which the carriage travels. FIG. 8 is a perspective view schematically showing the contact unit 304*a* on the carriage side observed from the above diagonally. FIG. 9 is a perspective view schematically showing the contact unit 301*c* on the head side observed from the above diagonally.

In the example of the present embodiment, the carriage 302 slidably reciprocates along a guide rail (not shown) through a portion 306 for receiving the rail. The relationship between the directions of the carriage reciprocation and ink discharge is as shown in FIG. 7 and FIG. 9. In FIG. 7, for example, the carriage reciprocates in the left- and right-hand directions while the ink is discharged downward.

The head cartridge 301 makes it possible to detachably install the head 301*a* and the ink tank 301*b* as an ink container. For the head 301*a,* the contact unit 301*c* on the head side is provided to receive the driving signals and power from outside. Also, the head 301*a* is provided with elements which transform the driving power into the energy for discharging ink, and with a base plate 301*d* made of Al for supporting the head base (not shown) on which the ink discharge ports are arranged.

On the carriage 302, the contact unit 304*a* on the carriage side is provided on a portion where it can abut on the contact unit 301*c* on the head side when the head cartridge 301 is installed. Also, the contact unit 304*a* on the carriage side is resiliently biased by a resilient member 305 toward the contact unit 301*c* on the head side so that it can be electrically connected to the contact unit 301*c* on the head side.

The cable 304 for supplying the driving signals and power to the contact unit 304*a* on the carriage side is mounted on the end portion of the carriage by means of the pressure board for cable 303 and others, and connected to the controller (not shown) in the main body of the recording apparatus.

This example of the present embodiment is the one in which a deelectrifying member such as the pressure board 303 for cable and others is arranged to cover the entire edge on the carriage side above the contact unit 304*a* on the carriage side, and at the same time, an extrusion 303*a* is provided for such member to cover the upper surface of the head partially.

The deelectrifying member pressure board 303 for cable exemplified for the present embodiment is conductively connected to the GND of the recording apparatus electrically through the abutting portion 307 between the pressure board 303 for cable and the exposed portion of the GND conductor of the cable 304.

Since the deelectrifying member exemplified for the present embodiment covers the upper part of the contact unit 304*a* on the carriage side, it is possible to more reliably prevent the recording operation from being hindered due to the flow of the static electricity to the controller of the recording apparatus from the operator's finger, hand, or other part of the body through the contact unit 304*a* on the carriage side when the head is attached to or detached from the carriage.

Further, according to the example of the present embodiment, the left and right sides, and lower part of the abutting portion for the contact unit 301*c* on the head side and contact unit 304*a* on the carriage side is surrounded by the edge 301*e* of the base plate 301*d,* and at the same time, the upper part thereof is surrounded by the extrusion 303*a* of the deelectrifying member 303. Therefore, it is possible to prevent the mist and others from adhering to the contact unit when ink is discharged from the ink discharge ports.

The Fifth Example of the Embodiment

Figure 10:
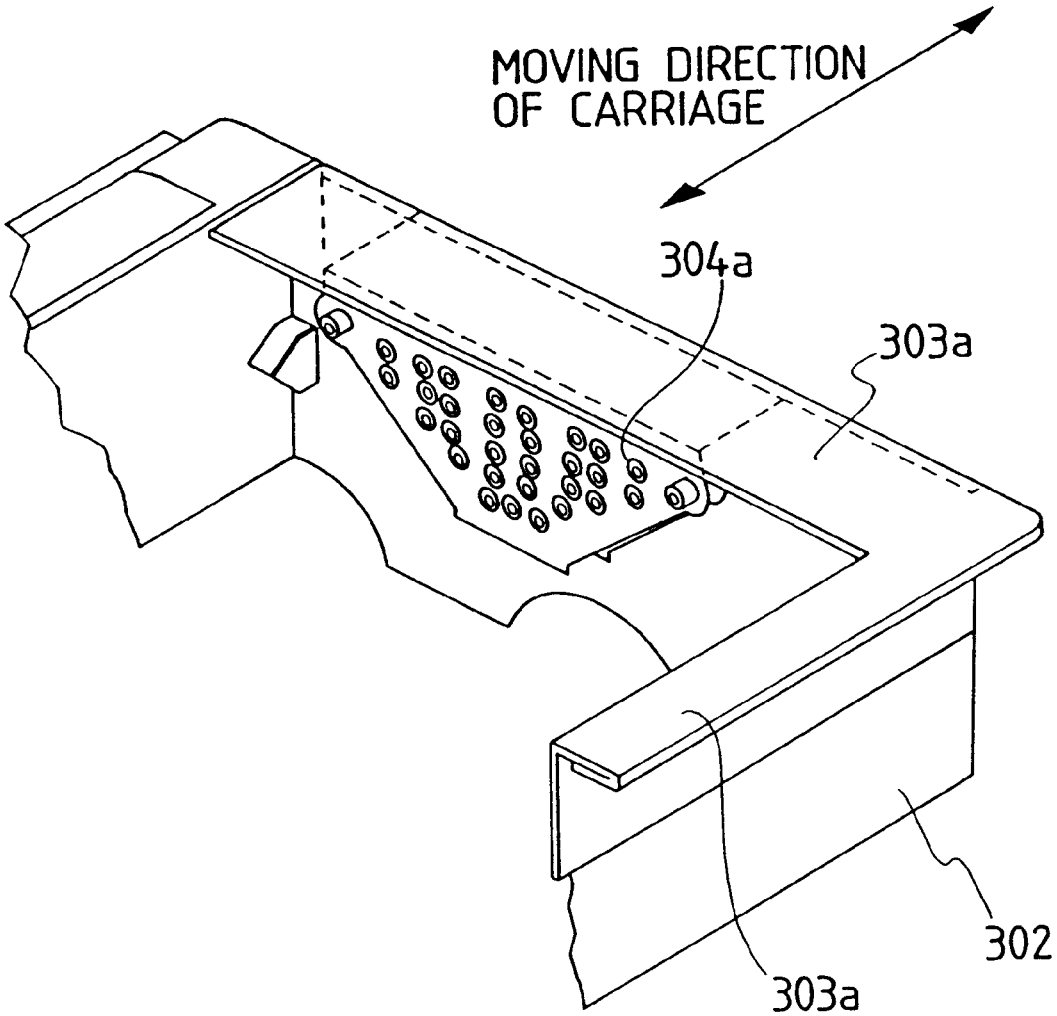
FIG. 10 is a perspective view schematically showing the principal part of the fifth example of the embodiment according to the present invention.

FIG. 10 is a perspective view schematically showing the contact unit 304*a* on the carriage side observed from above diagonally for illustrating the fifth example of the embodiment according to the present invention.

This example of the embodiment is such that the pressure board 303 for cable functioning as the deelectrifying member according to the fourth example described above is extendedly arranged to the side edge of the carriage nearer to the operating position of the operator. According to the deelectrifying member exemplified for the present embodiment, it is possible to prevent the static electricity from flowing into the controller of the recording apparatus through a part of the operator's body when the carriage and others are operated.

As described above using each of the examples of the embodiment, according to the present embodiment, it is possible to obtain the discharging effects by use of the discharging member. As a result, there is no need for any covering member or shuttering member as in the conventional art, thus making it possible to simplify the structure extremely, and reduce the number of parts for the implementation of cost reduction. Also, with the simpler structure, it is easier to stabilize the quality in preparing the parts, and enhance the reliability of the recording apparatus as a finished product.

Second Embodiment

Figure 11:
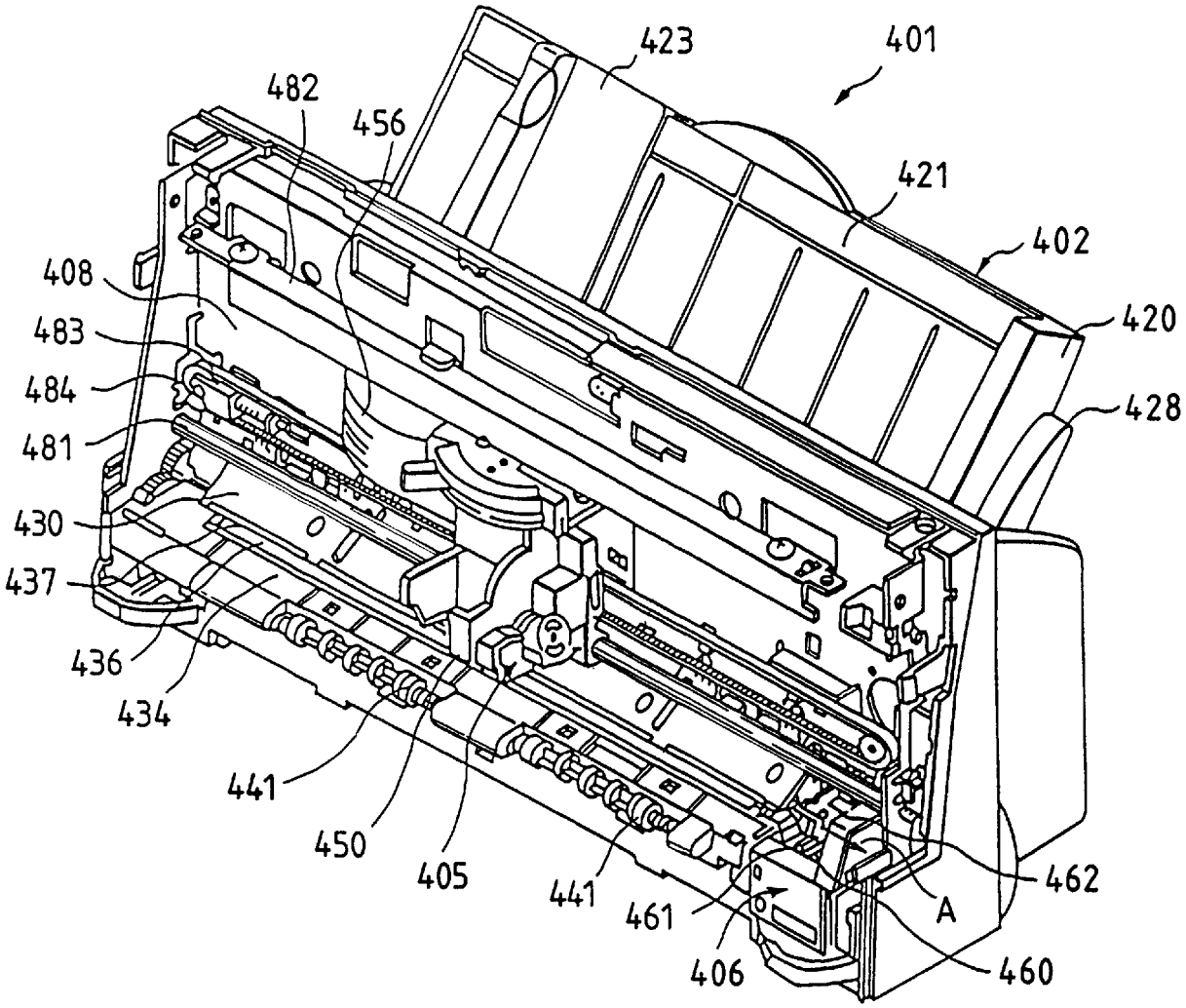
FIG. 11 is a perspective view schematically showing the entire structure of the recording apparatus according to the second embodiment of the present invention.
Figure 12:
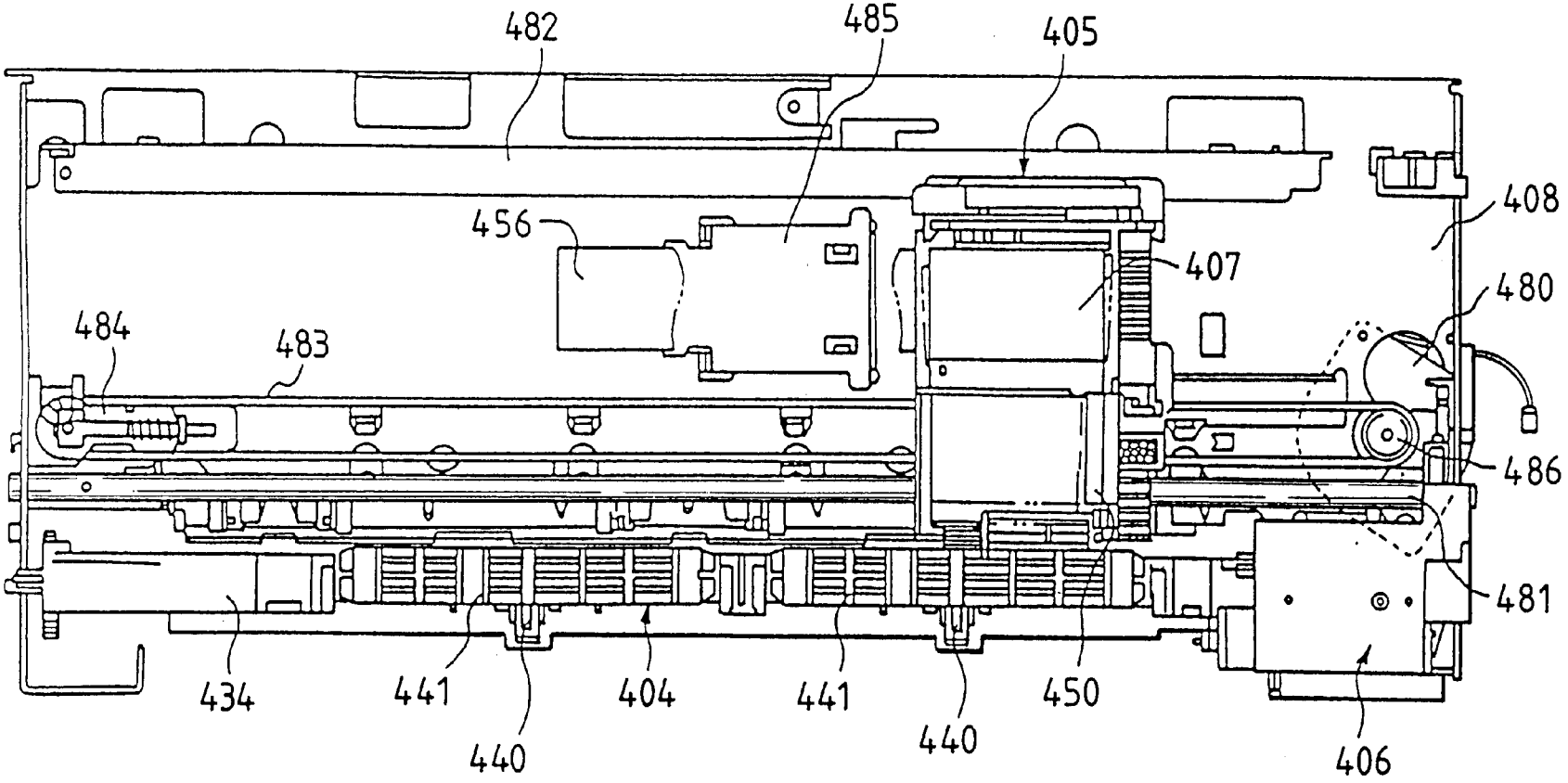
FIG. 12 is a front view schematically showing the recording apparatus according to the second embodiment of the present invention.
Figure 13:
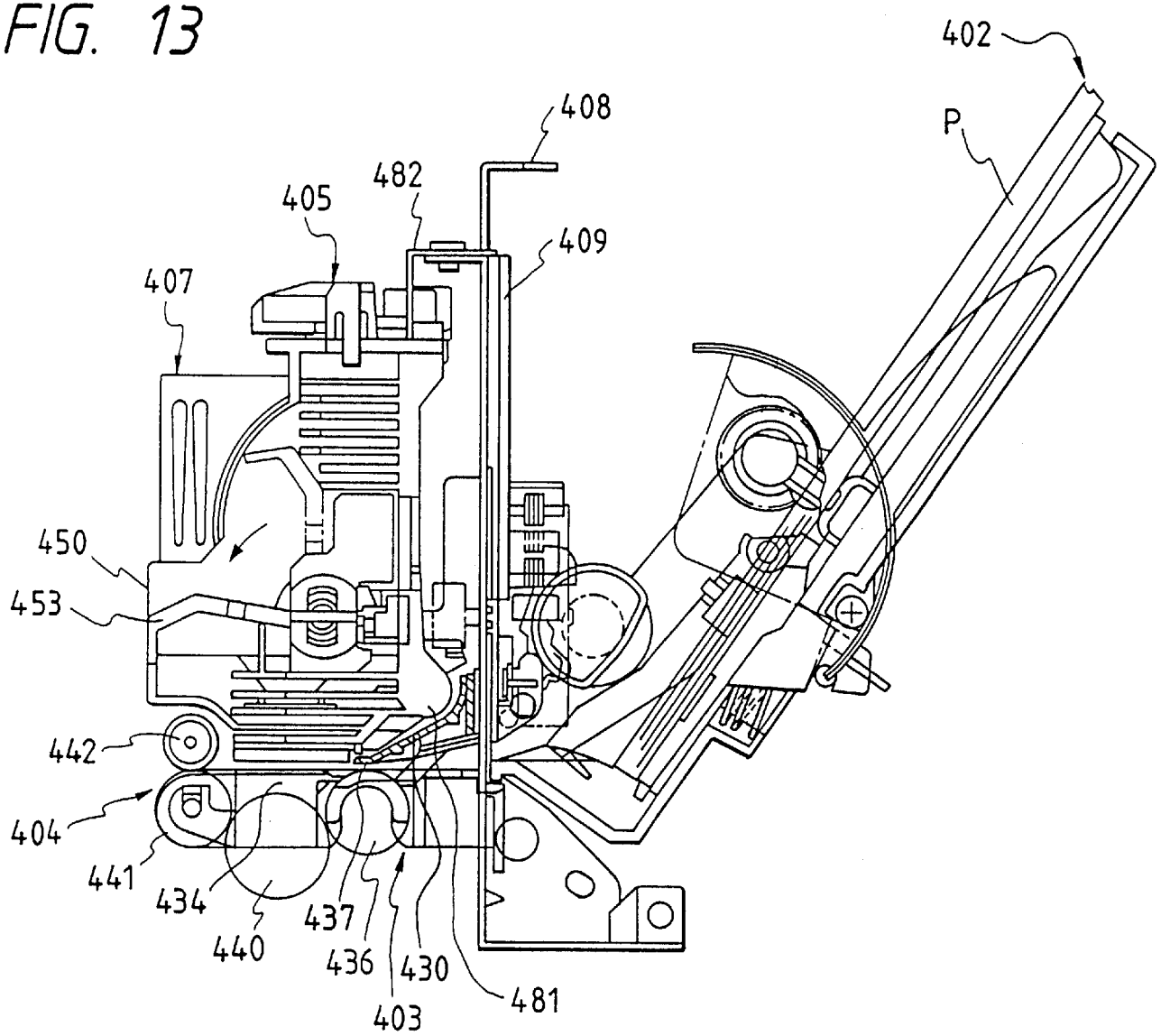
FIG. 13 is a cross-sectional view schematically showing the recording apparatus according to the second embodiment of the present invention.
Figure 14A:
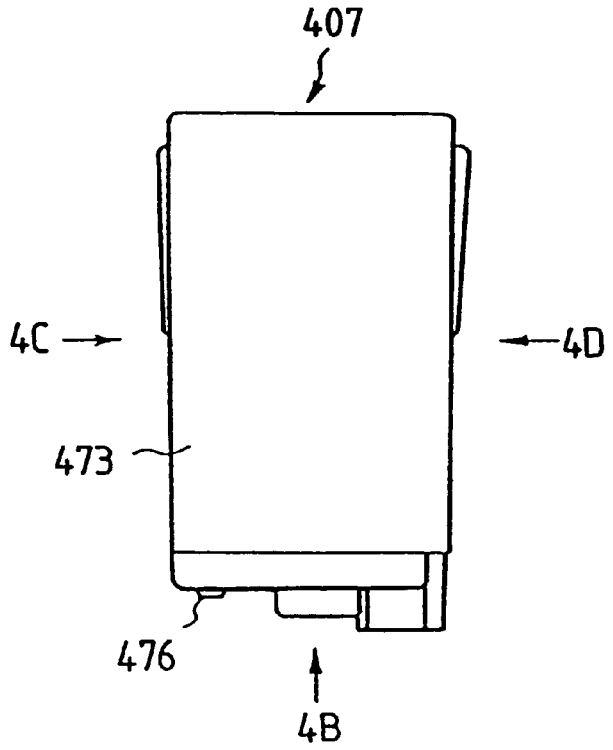
FIGS. 14A to 14D are views schematically showing the external appearance of the head according to the second embodiment of the present invention: 14A, a rear view; 14B, a front view observed in the direction indicated by an arrow 4B in FIGS. 14A; 14C and 14D, side views observed in the direction indicated by arrows 4C and 4D in FIG. 14A, respectively.
Figure 14B:
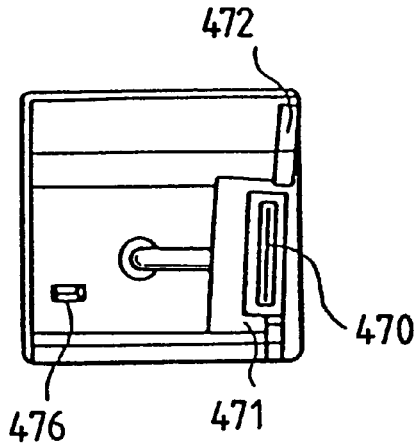
Figure 14C:
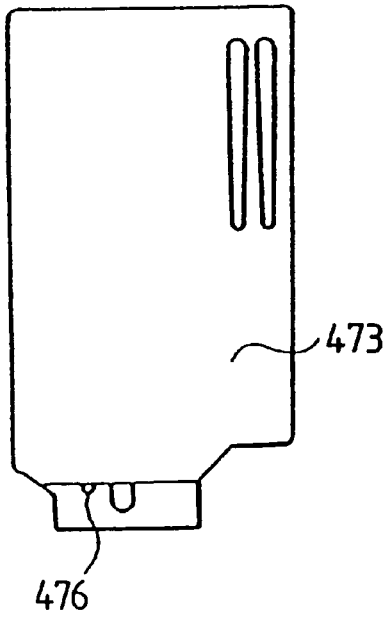
Figure 14D:
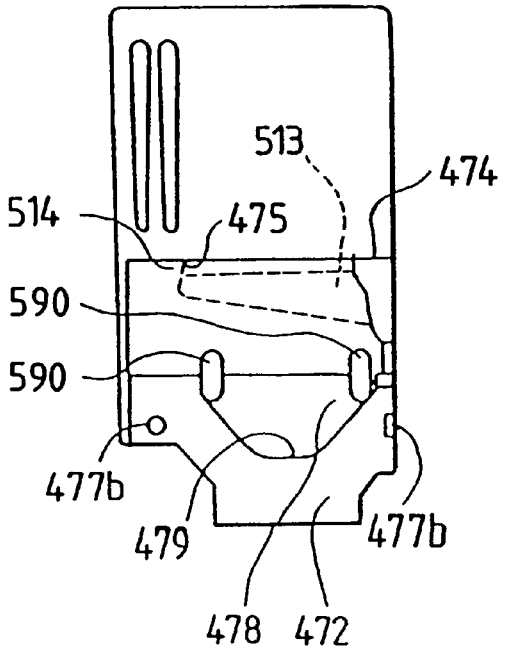

In conjunction with FIG. 11 to FIG. 23C, the description will be made of a second embodiment according to the present invention. This embodiment relates to a recording apparatus having a member capable of deelectrifying static electricity through the head before the contact unit on the head side and the contact unit on the carriage side abut on each other in operating the head installation to the carriage. The recording apparatus 401 having an automatic sheet feeder comprises a sheet supply unit 402; a sheet feed unit 403; a sheet exhaust unit 404; a carriage unit 405; and a cleaning unit 406. In this respect, FIG. 11 is a perspective view showing the entire structure of the recording apparatus 401. FIG. 12 is a front view of the recording apparatus 401. FIG. 13 is a cross-sectional view showing the structure of the recording apparatus 401.

The recording head will be described hereunder in detail.

As shown in FIGS. 14A to 14D, the recording head 407 comprises an ink tank 473 and a head unit 471. In the ink tank 473, a sponge is stuffed to impregnate ink. the head unit 471 is arranged in such a manner that on a base plate 472 made of aluminum, there are formed among others a silicon plate having a plurality of nozzles in a density of 360 per inch, heater elements, electrodes, and electrical wiring on it; a head base board; a liquid chamber; an ink filter; and an ink supply tube. The head unit 471 is mounted with an inclination to the tank 473 in order to incline the nozzle array at an angle of 1° to 4° to the vertical plane in the scanning direction from the driving system. Since the structure is arranged so that the nozzles are located on the tank 473 side with respect to the base plate 472, the piping and others do not penetrate the base plate 472. Therefore, the structural arrangement is made simpler to make color recording and others easier.

On the electrical contact surface, a cut off portion 479 is provided for the base plate 472, and by making the head base board double sided, the contact surface 478 is exposed. In this way, the contact surface 478 is provided in a location one step lower than the base plate 472. Also, an arrangement is made to provide fitting holes 477*a* and 477*b* on the base plate 472 in a location corresponding to the carriage 450, thus positioning the recording head 407.

In this respect, for the recording head 407, an easily exchangeable ink jet recording head is used. This head is integrally formed with an ink tank. The recording head 407 is capable of generating heat by use of heater and others serving as electrothermal transducers. By the heat thus generated, film boiling is created in ink. Change of pressure is generated by the development or contraction of air bubbles due to the film boiling, thereby to discharge ink from each of the nozzles 470 of the head 407 for the formation of an image on a sheet material P.

The carriage unit 405 will be described hereinbelow in detail.

The carriage unit 405 comprises a carriage 450 for mounting the recording head 407 on it. The carriage 450 is supported by a guide shaft 481 which enables it to reciprocate for scanning in the direction perpendicular to the feeding direction of the sheet material P, and by a guide rail 482 which maintains a gap between the recording head 407 and the sheet material P by holding the rear end of the carriage 450. In this respect, the guide shaft 481 and guide rail 482 are fixed to the chassis 408. Also, the carriage 450 is driven by a carriage motor 480 mounted on the chassis 408 through a timing belt 483. This timing belt 483 is tensioned and supported by an idle pulley 484. Further, the carriage 450 is provided with a flexible base board 456 for transmitting signals from the electric circuit board 409 to the recording head 407.

With the above-mentioned structure, a pair of rollers 436 and 437 feed the sheet material P to the line position (a position in the feeding direction of the sheet material P) where an image is formed when the image is formed on the sheet material P, and at the same time, the carriage 450 is caused by the carriage motor 480 to travel to the column position (a position perpendicular to the feeding direction of the sheet material P) where the image is formed, thus allowing the recording head 407 to face the position of the image formation. After that, the recording head 407 discharges ink to the sheet material P in accordance with the signals from the electric circuit board 409.

The sheet exhaust unit 404 is so arranged that a transfer roller 440 abuts upon the feed roller 436, and further, the transfer roller 440 abuts upon an exhaust roller 441. Therefore, the driving force of the feed roller 436 is transferred to the sheet exhaust roller 441 through the transfer roller 440. Also, the spur 442 which can freely rotate following the rotation of the sheet exhaust roller 441 abuts on the sheet exhaust roller 441. With the above-mentioned structure, the sheet material P for which an image is formed by means of the carriage unit 405 is nipped for exhaust by the sheet exhaust roller 441 and the spur 442 and conveyed to the tray (not shown) for exhaust sheets or the like.

The Sixth Example of the Embodiment

Now, each of the principal parts of the carriage unit 405 will be described in detail.

Figure 15B:
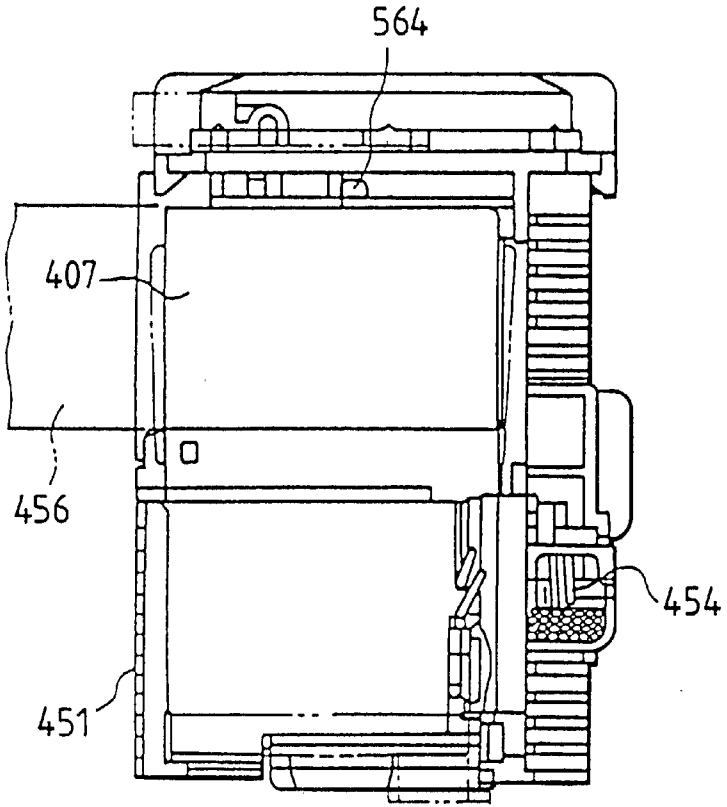
FIGS. 15A to 15B are front views schematically showing a carriage represented as the sixth example of the embodiment in relation to the second embodiment according to the present invention: 15A, a state before a recording head is mounted completely; 15B, a state where the head is completely mounted.
Figure 15A:
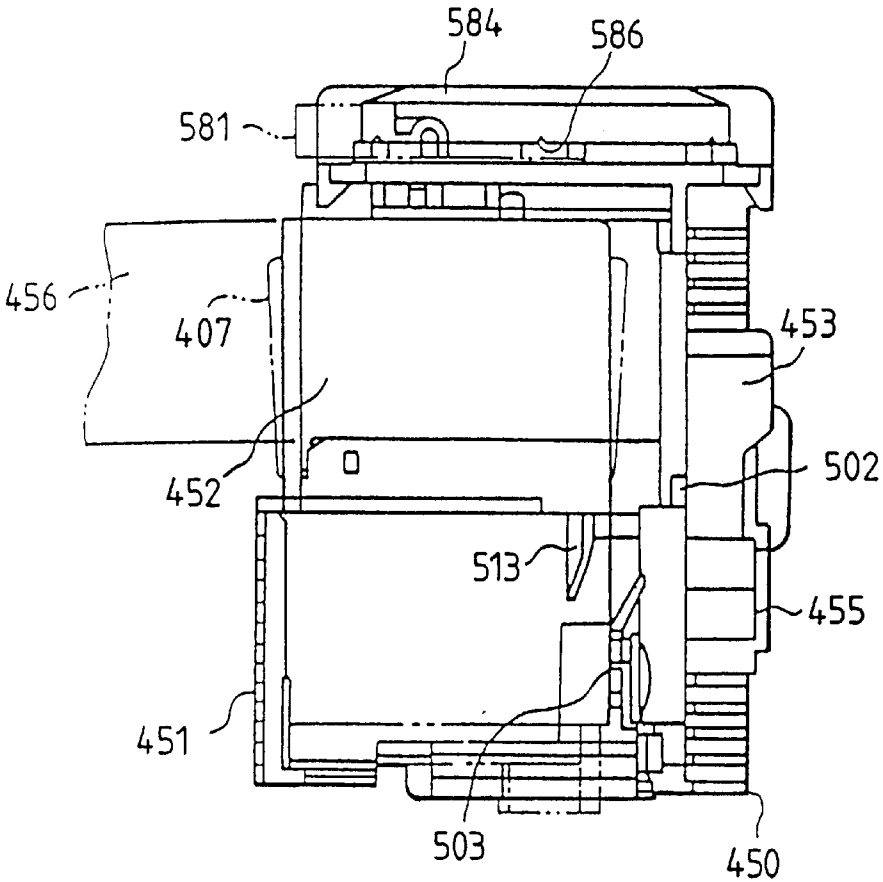
Figure 16:
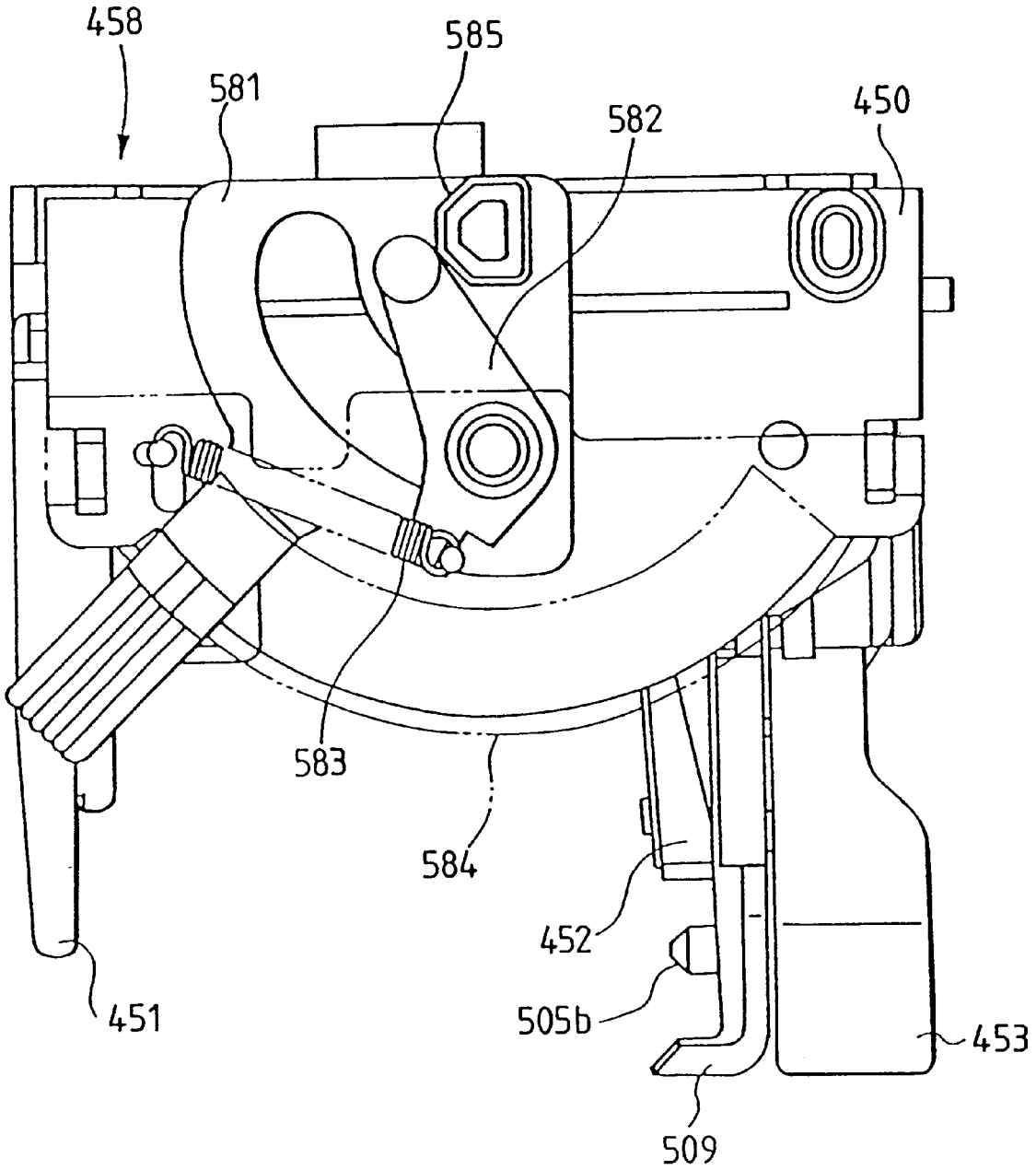
FIG. 16 is a plan view schematically showing the carriage represented as the sixth example of the embodiment according to the present invention.
Figure 17:
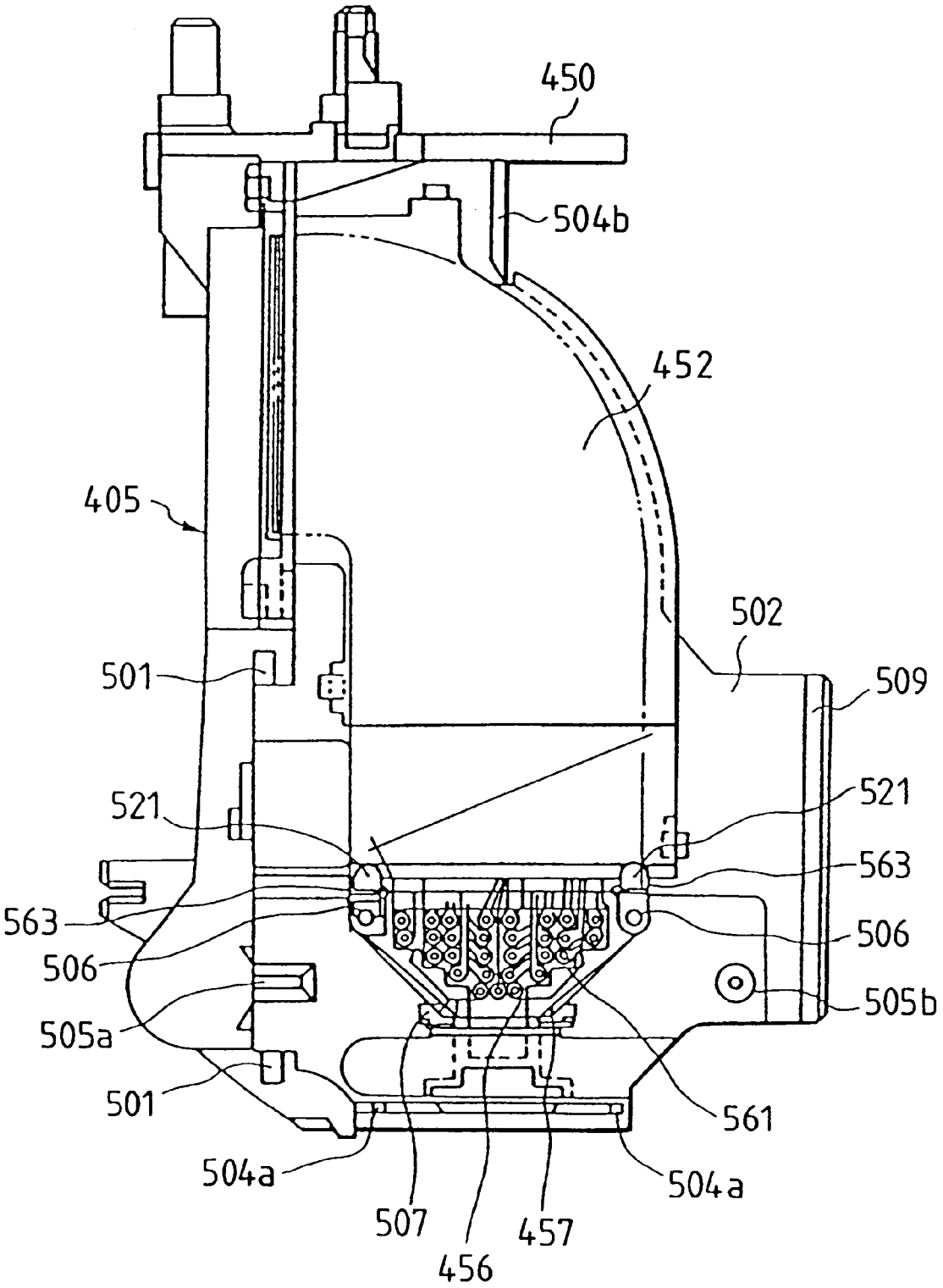
FIG. 17 is a view schematically showing the contact unit of the carriage represented as the sixth example of the embodiment according to the present invention.
Figure 18A:
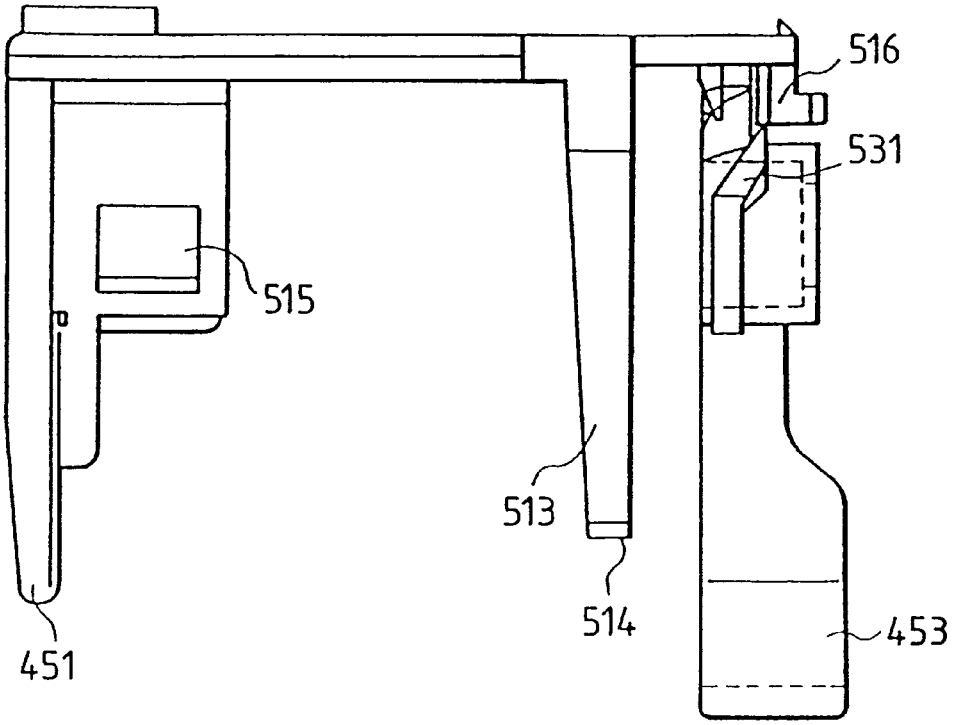
FIGS. 18A to 18B are views schematically showing the principal part of a mechanism for attaching or detaching the head represented as the sixth example of the embodiment according to the present invention.
Figure 18B:
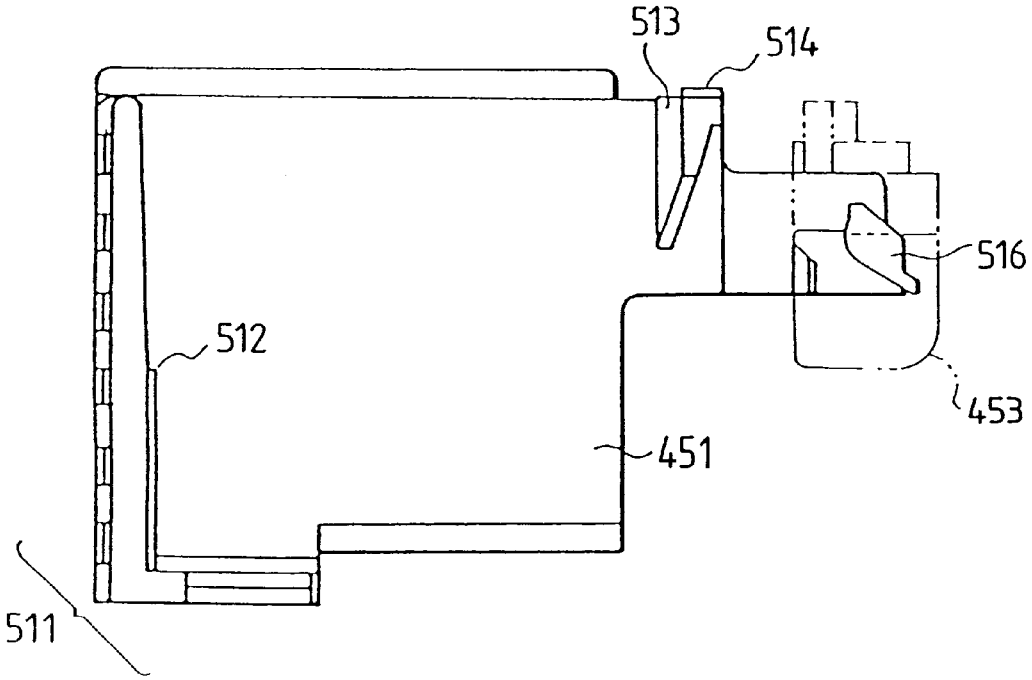
Figure 19A:
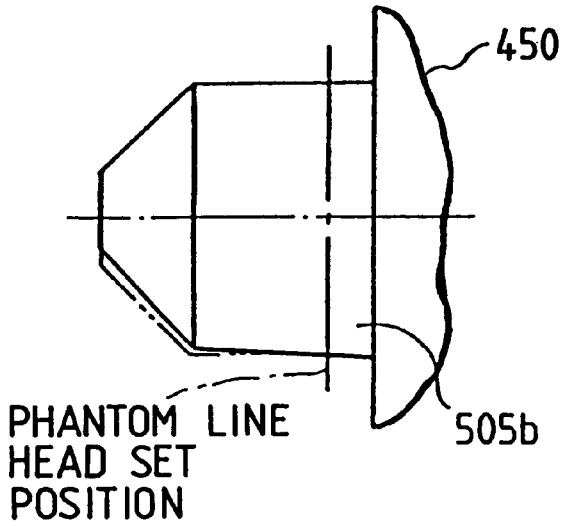
FIGS. 19A and 19B are views schematically illustrating a fitting pin for the head of the carriage represented as the sixth example of the embodiment according to the present invention.
Figure 19B:
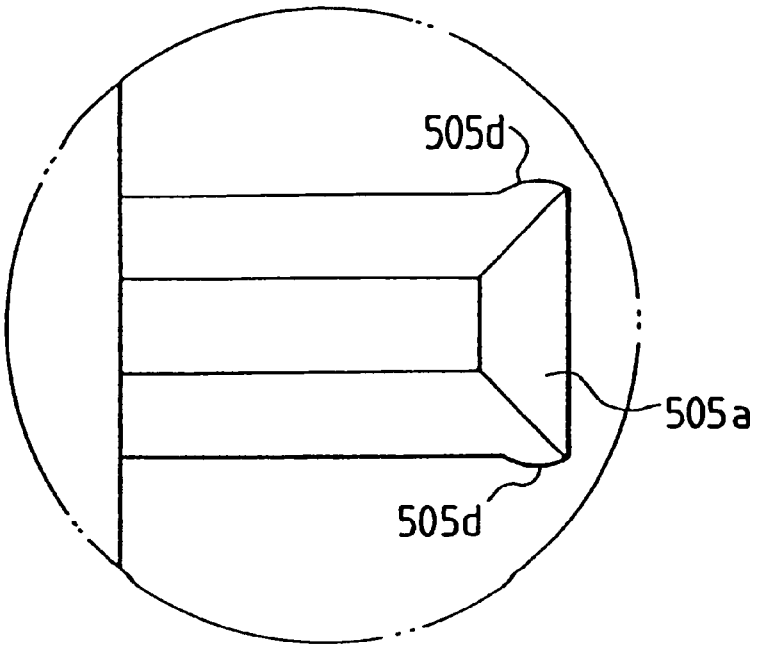
Figure 20A:
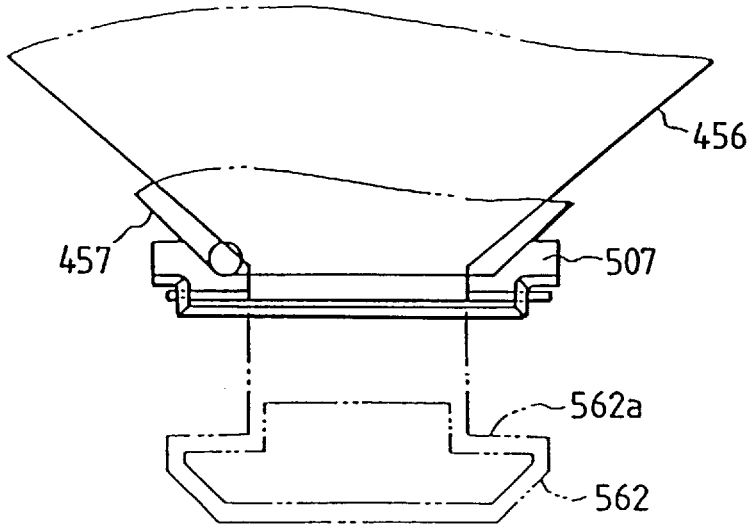
FIGS. 20A to 20C are views schematically illustrating the assembling state of the leading portion of a flexible base represented as the sixth example of the embodiment of the present invention.
Figure 20B:
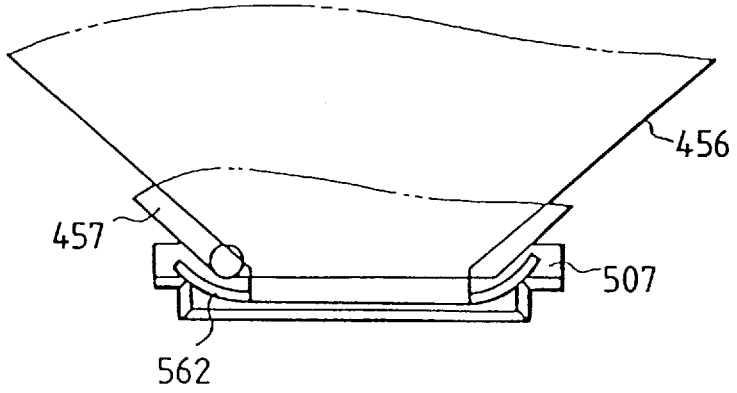
Figure 20C:
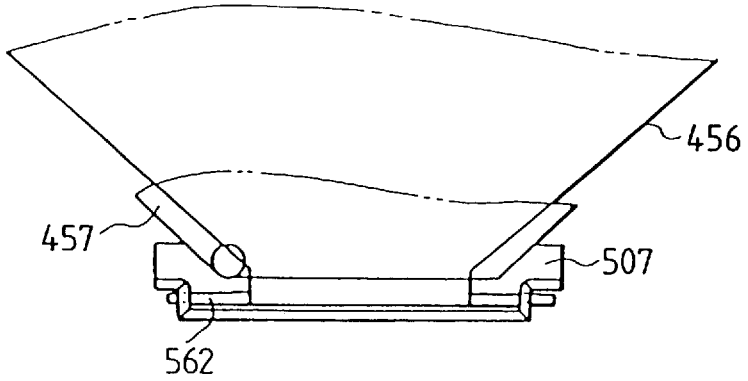
Figure 21:
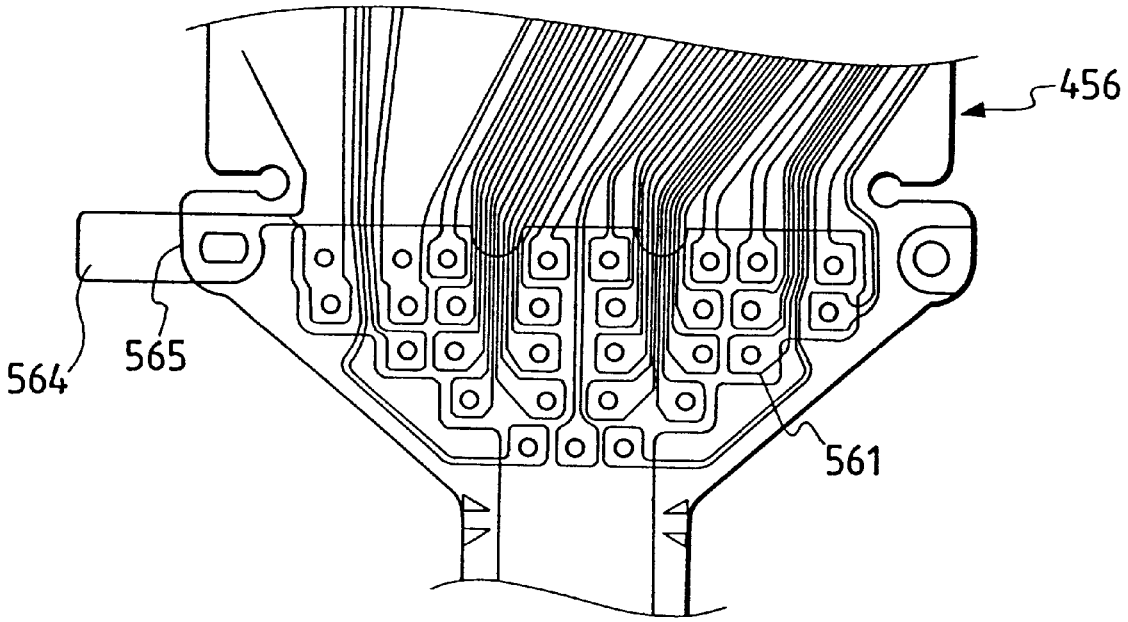
FIG. 21 is a front view schematically showing the contact unit of the flexible base where a deelectrifying member is arranged according to the sixth example embodying the present invention.
Figure 22:
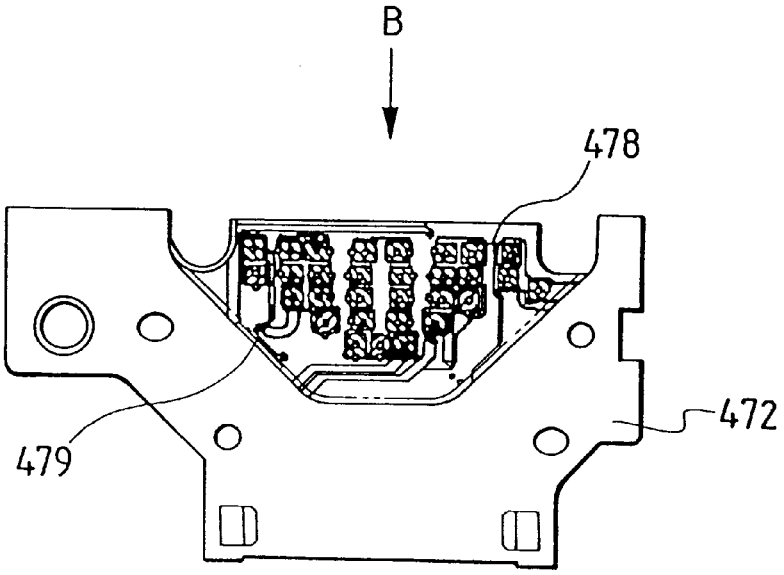
FIG. 22 is a front view schematically showing the base plate unit of a recording head.
Figures 23A, 23B, 23C:
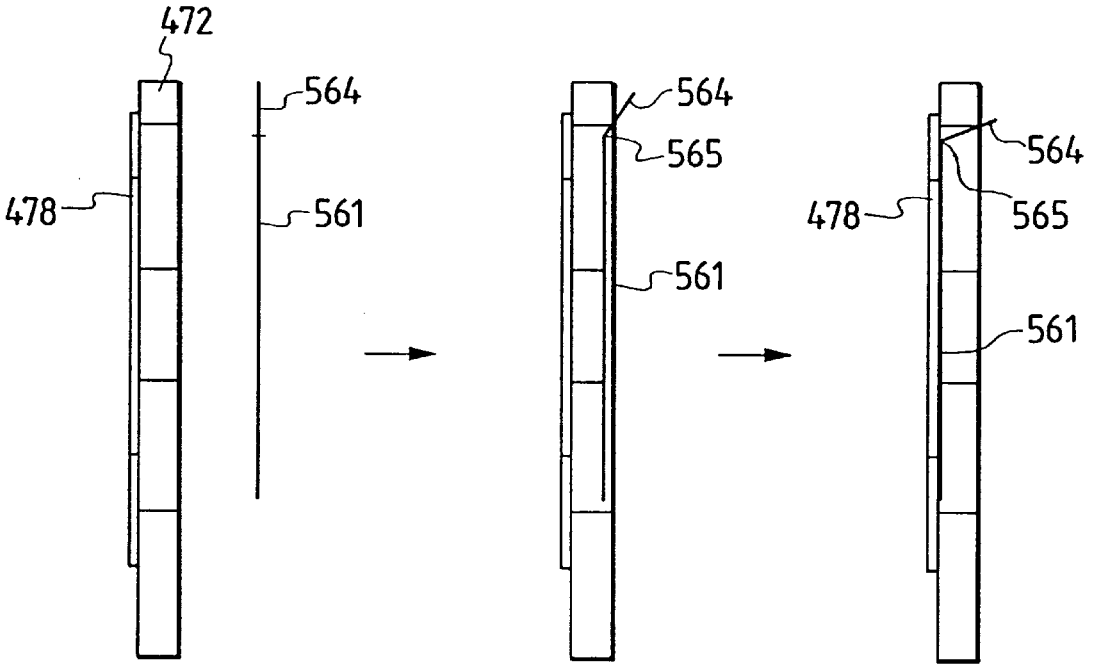
FIGS. 23A to 23C are views schematically illustrating the connecting state between the deelectrifying member and the recording head observed in the direction indicated by an arrow B according to the sixth example embodying the present invention.

The carriage unit 405 is arranged in the form of a unit by mounting each of the required parts on the carriage 450. FIGS. 14A to 14D illustrates the external appearance of the recording head 407. FIGS. 15A and 15B are front views showing the carriage unit 405. FIG. 16 is a plan view showing the carriage unit 405. FIG. 17 shows the structure of the contact surface 503 and others of the carriage unit 405. FIGS. 18A and 18B show the structure of the principal part of a mechanism for attaching or detaching the head 407. FIGS. 19A and 19B illustrate the structure of a pin 505 for fitting the head to the carriage 450. FIGS. 20A to 20C are views illustrating an assembling state of the leading end 562 of the flexible base board 456. FIG. 21 is a front view showing the contact unit 561 of the flexible base board 456 where a deelectrifying member 564 is arranged. FIG. 22 is a front view showing the base plate unit of the recording head. FIGS. 23A to 23C illustrate the state where the deelectrifying member 564 and the recording head abut upon each other.

The unit for attaching or detaching the head 407 comprises the carriage 450; a head holder 451; a base cover 452; a hook lever 453; a contact spring 454; a hook cover 455; the flexible base board 456; and a rubber pad 457.

As shown in FIGS. 15A and 15B, the head holder 451 is structured to mount the head 407 on it and slide in the left and right directions along the guide 501 provided above the carriage 450. For the head holder 451, there are arranged a unit 511 for guiding the head 407 and a unit 512 for pressing the head 407 to the contact surface 503 of the side plate 502 which stands vertically to the carriage 450, and to the positioning surface 504. There are three points for the positioning surface of the side boards 502 of the carriage. An arrangement is made to correspond two points (504*a*) on the base plate 472 in the vicinity of the nozzles 470 of the head to one point (504*b*) above the ink tank 473 of the head 407. The contact surface 503 of the head 407 and carriage 450 is arranged to be positioned within an triangle formed by the three points 504*a* and *b* on the positioning surface. The pressure unit 512 of the head holder 451 is located within in this triangle. Also, a guide arm 513 is arranged in a position opposite to the pressure unit 512 of the head holder 451. When the head 407 is detached from the contact surface 503, this guide arm 513 is operated for the head 407. On the side board 502 of the carriage 450, a rib 509 is arranged to serve dually as a guide when the head 407 is attached or detached in order to protect and blindfold the contact surface 561 and others of the flexible base board 456.

As shown in FIGS. 14A to 14D, a guide 474 is arranged on the side face of the ink tank 473 for the head 407 which is installed along the upper surface of the guide arm 513. In a given position where the head 407 is installed, a recess 475 is provided for the guide 474 for the head 407, and an extrusion 514 is provided as a regulating means for in a position corresponding to the head holder 451. Further, on the bottom face of the head 407, an extrusion 476 is provided. On the receiving portion corresponding to the head holder 451, a recess 515 is provided for the corresponding extrusion 476. In this way, the nozzle surface 470 does not abut on the platen 434 and others when the head 407 is installed. Therefore, there is no possibility that the head is damaged. In addition, a click feeling is obtainable when the head is installed, thus enhancing the sense of installation. Also, by means of the hooking action of the extrusion 514 of the head holder 451, there is no possibility in attaching or detaching the head 407 that the head 407 falls off forwardly or any instability thereof due to displacement or the like after installation.

The hook lever 453 is rotatively mounted on the side board 502 of the carriage 450. Around the rotational center of the hook lever 453, a contact spring 454 is provided to bias the hook lever 453 in the direction indicated by an arrow in FIGS. 15A and 15B. A hook cover 455 is mounted to cover and support the hook lever 453 so that the hook lever 453 does not fall off from the carriage 450. As shown in FIGS. 18A and 18B, the hook lever 453 and the head holder 451 are arranged, respectively with the cams 516 and 531 which abut on each other, and the arrangement is made to allow the head holder 451 moves in the left and right directions by the rotation of the hook lever 453. Also, the biasing force of the contact spring 454 provides the head holder 451 with a force for pressing the head 407 through the hook lever 453.

On the side board 502 of the carriage 450, fitting pins 505 are arranged for positioning the head 407. As shown in FIG. 17, FIGS. 19A and 19B, two fitting pin 505 are provided corresponding to the fitting holes 477 of the base plate 472. The base plate 472 of the head 407 is arranged to be inclined at an angle of approximately 1° to 4° to the scanning direction of the carriage 405 from the head 407 drive. In order to meet the inclined fitting holes 477, one of the fitting holes 477 of the base plate 472 of the head 407 is arranged to be a square hole 477*a*. Then the corresponding fitting pin 505*a* on the carriage 450 side is arranged to be a square pin having partially a shape of circular column. Further, the under-cut portion of the fitting pin 505*b* on the carriage side, which corresponds to the round hole 477*b*, is removed because of the structural configuration of the carriage so that the fitting can be made in a position where the head 407 abuts on the positioning surface 504 of the carriage. In this way, it is possible to position the head 407 exactly and smoothly with respect to the inclined base plate 472 without any complicated structural arrangement.

As shown in FIG. 17, there is provided a rubber pad 457 made of a resilient material such as silicon rubber having a rubber hardness of 30° to 50° on the contact surface 503 of the side board 502 of the carriage 450 in order to make the electrical contact possible with the head 407. Then, on the rubber pad, the contact unit 561 of the flexible base board 456 is arranged. Both the rubber pad 457 and the flexible base board 456 are positioned by positioning pins 506 provided for the side board 502 of the carriage 450. Here, slits 563 are arranged on the opposite side of the contact surface 561 whereby the flexible base board 456 is positioned so that any possible deformation and others occurring in the process of assembling may not affect the contact unit 561. The leading end 562 of the contact unit 561 of the flexible base board 456 is made narrower to fit the configuration of the base plate 472 of the head 407, and on the end portion thereof, a hook 562*a* is arranged. In this way, the contact unit 561 is shaped in a triangle, and then, the numbers of the contact pads are reduced more toward the leading end to facilitate the forming of the signal lines for the provision of its higher density. Also, it becomes easier to take processing steps in the leading end 562 of the flexible base board 456. On the side board 502 of the carriage 450, a slit hole 507 is provided for inserting the leading end 562 of the flexible base board 456 into it. As shown in FIGS. 20A to 20C, the leading end 562 is curved and inserted into the slit hole 507. When the leading end passes the slit hole 507, it becomes straightened and hooked. Therefore, this leading end does not fall off. With this arrangement, the leading end is in good contact with the contact surface of the head 407 because the leading end is free while the contact surface 561 of the flexible base board 456 is not rigid. When the head 407 is installed, the contact surface 503 of the carriage 450 is allowed to insert itself in the cut-off portion 479 of the base plate 472 of the head 407 as shown in FIG. 22 and abut upon the contact surface 478 on the base board formed on the inner side of the cutoff portion 479.

Now, an example of deelectrification will be described specifically.

As shown in FIG. 21, a resilient deelectrifying member 564 is provided for the contact unit 561 of the flexible base board 456. This member is electrically connected to the GND pattern. As shown in FIGS. 23A to 23C, the deelectrifying member 564 abuts by its resiliency on the base plate 472 of the recording head 407 when the recording head 407 is set in the carriage unit 405. The flexible base board 456 comprises a base board made of an insulator such as polyimide, a conductor such as rolled copper, and a cover made of an insulator such as polyimide. The deelectrifying member 564 utilizes the fact that its resiliency changes at the end 565 of the aforesaid cover for making it a buckling point of the member. The surface of the aforesaid conductor is Ni, Au plated for the portion of the deelectrifying member 564 where it abuts upon the base plate 472 of the recording head 407. The base plate 472 is either electrically connected to or arranged to place it near the GND of the inner circuit of the recording head 407. When the head 407 is installed on the carriage 450, the hook lever 453 is pulled up as shown in FIG. 15A to cause the head holder 451 to be brought to the left-hand side so that the head 407 can be installed. In this state, the head 407 is mounted, and the hook lever 453 is rotated downward as shown in FIG. 15B to cause the head holder 451 to move to the right-hand side together with the head 407. In this way the head 407 is positioned, and the electrical contact and others are made. In this process, the contact unit 561 of the flexible base board 456 is inserted into the cut-off portion 479 of the base plate 472 of the head 407 as shown in FIG. 23A. Then it abuts on the contact surface 478 formed on the inner side of the cut-off portion 479 (FIG. 23C). Before this event, however, the deelectrifying member 564 abuts on the base plate 472 to conduct deelectrification by discharging the static electricity charged on the plate. When the flexible base board 456 further approaches the head 407, the deelectrifying member 564 is buckled at the buckling point 565 while abutting the base plate 472 utilizing its resiliency as shown in FIG. 23B. Then, as shown in FIG. 23C, the contact unit 561 abuts upon the contact surface 478. With the structure described above, the static electricity can escape to the GND even if it is discharged from the operator's hand when he exchanges the recording head 407. Therefore, no electric circuit is damaged.

Also, the length of the flexible deelectrifying member is arranged to be greater than the depth of the recess where the contact surface of the recording head is lower than the surrounding surface in the installing direction of the recording head. Therefore, there is no possibility that the deelectrifying member is trapped by the recording head when the head is attached or detached.

The flexible base board 456 is drawn along the side board 502 of the carriage 450, and folded vertically and fixed by the base cover 452 to the carriage 450. In this case, since an extrusion for provisional detention is provided for the flexible base board 456, it is possible to fix the flexible base board 456 by retaining the extrusion for provisional detention on the carriage 450. Therefore, the required assembling can be performed effectively when the base cover 452 is mounted. Further, a pressure section 521 is arranged for the base cover 452 in order to prevent the fitting parts of the rubber pad 457 and positioning holes of the flexible base board 456 from falling off from the pints 506 on the carriage 450. Also, a recess 590 is provided for the recording head 407 so that it can escape from the extruded portion of the pressure section 521 arranged for the positioning pins 506 and the base cover 452. As a result, the length of the positioning pins 506 and the thickness of the pressure section 521 of the base cover 452 can be gained sufficiently in order to reliably position the rubber pad 457 and the flexible base board 456 as well as reliably prevent them from falling off. The flexible base board 456 is fixed to the chassis 408 by a flexible fixing plate 485 to make its curvature changeable depending on the position of the carriage unit 405. Then, in response to the movement of the carriage unit 405, the head driving signals are transmitted to the head 407 from the electric circuit board 409.

With the structure described above, it is possible to easily execute the attachment or detachment of the head 407 to or from the carriage unit 405, as well as to easily keep and position the head together with the execution of the electrical connection among others. FIGS. 15A and 15B are front views showing the carriage unit 405 when its attachment and detachment are executed. When installing the head 407, the hook lever 453 is pulled upward as shown in FIG. 15A to bring the head holder 451 to the left-hand side so that the head 407 can be installed. In this state, the head 407 is installed. Then the hook lever 453 is rotated downward as shown in FIG. 15B to cause the head holder 451 to move to the right hand side together with the head 407 for positioning the head 407 as well as executing the electrical contact and others. Thus an image can be formed on a sheet material P. Further, when the head 407 is removed from the carriage unit 405, the hook lever 453 is pulled upward as shown in FIG. 15A to cause the head holder 451 to move to the left-hand side. Then the guide arm 513 of the head holder 451 is pressed to the left-hand side. Thus the head 407 can be removed from the carriage unit 405.

On the upper part of the carriage 150, a unit 458 for adjusting the gap between the recording head 407 and the recording sheet P. As shown in FIG. 16, this gap adjusting unit comprises an adjustment lever 581, a pressure lever 582, a pressure spring 583, and a top cover 584.

The adjustment lever 581 is structured rotatively by inserting a pin into a hole provided for the carriage 450. The adjustment lever 581 is provided with the polygonal sliding surfaces 585 each having different distance from the rotational center of the adjustment lever corresponding to the numbers of gap positions between the head and sheet. The pressure lever 582 is rotative around a pin provided for the carriage 450. The sliding surfaces 585 of the adjustment lever 581 is biased by the pressure spring 583 to the guide rail 482. By changing the sliding surfaces 585 of the adjustment lever 581, the carriage 450 rotates around the guide shaft 481 thus changing the gaps between the head and sheet. The top cover 584 is fixed by nails to both sides of the carriage 450 to hold the adjustment lever 581, pressure lever 582 and others. Further, the leading end portion of the adjustment lever 581 is resilient, and with the corresponding groove 586 of the top cover 584, the adjustment lever 581 is fixed to form a given gap between the head and sheet.

The carriage unit 405 is arranged to reciprocate for scanning in such a manner that a bearing for the carriage 450 is provided for the guide shaft 481 fixed to the chassis 408, and likewise, the adjustment lever 581 and pressure lever 582 are arranged to slide on the guide rail 482 fixed to the chassis 408 (see FIG. 13). To the rear of the carriage 450, a timing belt 483 is fixed. This timing belt 483 is tensioned between the pulley 486 mounted on the shaft of the carriage motor 480 fixed to the chassis 408, and the idle pulley 484 fixed to the chassis 408 for tensioning the timing belt 483 (see FIG. 11).

The Seventh Example of the Embodiment

Figure 24:
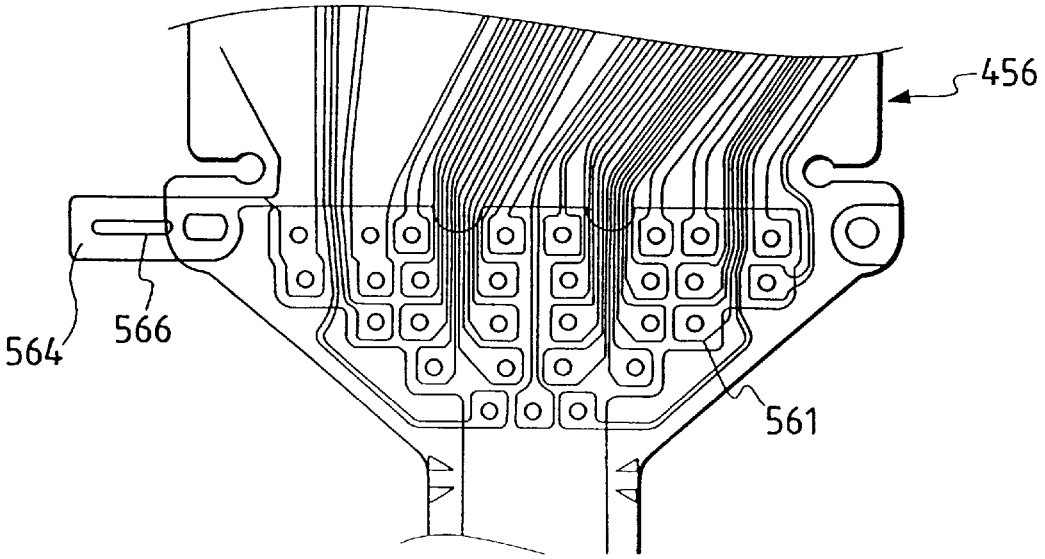
FIG. 24 is a front view schematically showing the contact unit of the flexible base provided for the deelectrifying member according to the seventh example embodying the present invention.

In the sixth example of the embodiment, deelectrifying member 564 is structured in the form of one plate. However, it may be possible to arrange the structure so that a through hole 566 is provided in the central part of the member as shown in FIG. 24. The hole 566 is arranged on a straight line with a same width in the longitudinal direction of the deelectrifying member 564 as shown in FIG. 24. With the structure described above, rigidity of the deelectrifying member 564 can be adjusted for setting a given contact pressure without changing the width thereof.

The other structures are the same as those of the sixth example of the embodiment.

According to the second embodiment, the following effects are obtainable:

(1) The provision of the deelectrifying member on the contact surface of the flexible base board makes it possible to allow the deelectrifying member to abut upon the recording head by the utilization of its resiliency. Therefore, there is no need for the provision of any other resilient member such as a spring. Accordingly, no separate arrangement is needed for any members required for mounting such resilient members. A lower cost and space saving can be implemented.

(2) Since the contact surface of the head is arranged in the cut-off portion of the base plate, it is easy to allow the deelectrifying member to abut upon the contact surface of the recording head.

(3) A buckling point is generated when the deelectrifying member abuts upon the recording head. This point can be set at a given position.

(4) Since the length of the flexible deelectrifying member is made greater than the depth of the recess where the contact surface of the recording head is lower than the surrounding surface in the mounting direction of the recording head. Therefore, the deelectrifying member is not trapped by the recording head when the recording head is attached or detached.

(5) The provision of an elongated through hole on the deelectrifying member makes it possible to adjust the rigidity of the deelectrifying member in order to set a given contact pressure without changing the width thereof.

Third Embodiment

Figure 25A:
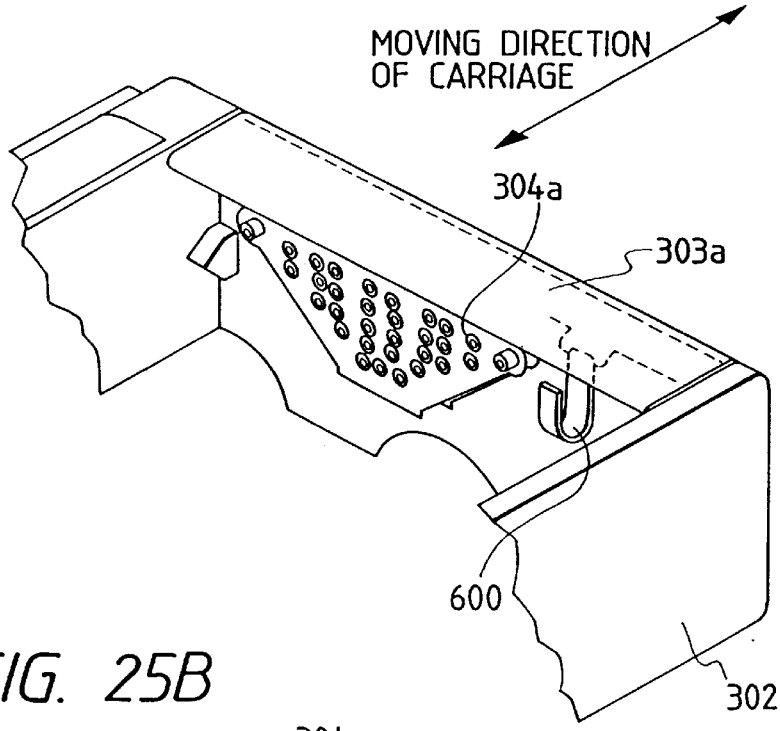
FIGS. 25A and 25B are perspective views schematically showing the carriage for which the deelectrifying member is provided according to the eighth example of the embodiment in relation to a third embodiment of the present invention.
Figure 25B:
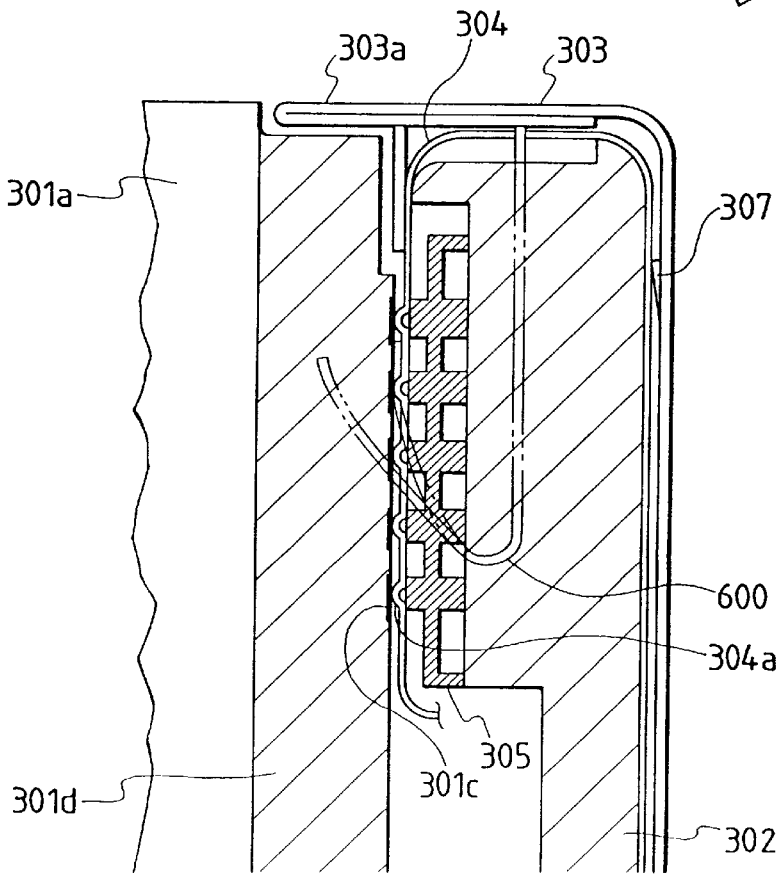

In conjunction with FIGS. 25A and 25B, the description will be made of a third embodiment according to the present invention.

The present embodiment relates to a recording apparatus having a deelectrifying member capable of deelectrifying the static electricity charged through the operator's body such as finger and hand when he executes the attachment or detachment of a recording head, and the static electricity charged through the head member when its attachment or detachment is executed.

The recording apparatus of the present embodiment is such that a second deelectrifying member 600 which is a resilient member formed almost in the U letter shape is arranged in the vicinity of the contact unit 304*a* on the carriage side, and that such resilient member can abut upon the base plate 301*d* made of Al of the head 301*a* of the apparatus described as the fourth example of the first embodiment. FIG. 25A is a perspective view schematically showing the contact unit 304*a* on the carriage side observed diagonally form the above. FIG. 25B is a cross-sectional view schematically showing the vicinity of the portion where the contact unit 301*c* on the head side and the contact unit 304*a* on the carriage side abut upon each other. In FIGS. 25A and 25B, the same reference numerals are provided for the members corresponding to those appearing in the fourth example of the embodiment (FIG. 7 to FIG. 9).

The Eighth Example of the Embodiment

In conjunction with FIGS. 25A and 25B, the detailed description will be made of an eighth example of the embodiment according to the present invention.

In this example of the embodiment, a resilient U-letter shaped member 600 is provided as a second electrifying member in addition to the pressure board 303 for cable which serves as a first deelectrifying member as described in the forth example of the embodiment. Corresponding to the installation of the head 301*a* (or head cartridge 301) on the carriage 302, the head 301*a* and the resilient U-letter shaped member 600 abut upon each other in a position where there is still a distance before the static electricity flows from the head 301*a* side to the contact unit 304*a* on the carriage side through the inclusion of a space prior to the contact unit 301*c* on the head side abutting actually upon the contact unit 304*a* on the carriage side. In this way, the static electricity charged on the head 301*a* or head cartridge 301 is deelectrified when it flows to the GND of the recording apparatus through the resilient U-letter shaped member 600, pressure board for cable 303, abutting section 307, and GND section for cable. The resilient U-letter shaped member 600 is deformed resiliently corresponding to the installation of the head 301*a* on the carriage 302, and at the same time, the contact units 304*a* and 301*c* are in contact with each other.

According to the present embodiment described above in detail, it is possible to prevent any malfunction of the recording apparatus from taking place due to the flow of static electricity from a part of the operator's body or through the head member to the contact unit on the carriage side when the head or head cartridge is attached to or detached from the carriage among others.

In this respect, the resilient U-letter shaped member which functions as the second deelectrifying member in this example of the embodiment abuts on the head unit while the head 301*a* and contact unit 304*a* on the carriage side still keep a given distance between them. This member is thus capable of conducting the static electricity charged on the head or head cartridge 301*b* to the cable GND on the carriage side. Therefore, if only the member is capable enough to serve this purpose without hindering the contact units 304*a* and 301*c* to abut upon each other, the member is not necessarily made resilient. It is needless to mention that such resilient member as above can be replaced with some other member.

In each of the above-mentioned embodiments, there has been exemplified the exchangeable recording head of an ink jet type which is suitably used for giving ink to any ink supporting elements such as cloth, paper, thread, sheet material, but the present invention is not limited thereto, of course. For example, the same effect is obtainable by use of a recording head of one-installation type instead of an exchangeable recording head, and also, by the application of a thermal transfer, wire-dot, or other methods for the recording head.

In each of the above-mentioned embodiments, the pressure board for cable which serves as the deelectrifying member is made of a metal, but it may be possible to use a material the surface of which is conductive.

Also, it may be possible to arrange a structure to allow the static electricity deelectrified from the deelectrifying member to flow to a varistor (other than the GND of the recording apparatus) through a cable provided with the wiring which passes the static electricity from the deelectrifying member, not necessarily being allowed to flow to the GND of the recording apparatus only.

Also, in each of the above-mentioned embodiments, the description has been made using a recording apparatus in which the carriage serving as a member for detachably holding the recording head reciprocates in the direction different from the feeding direction of the sheet member, but it may be possible to use a recording apparatus which detachably holds in its holding member a recording head of a full-line type having the length of the recording unit corresponding to the width of the sheet member serving as a recording medium. Furthermore, the present invention is applicable in a case where a reading head is used instead of a recording head when the sheet member is adopted as a source document to be read.

Also, the kind and number of recording heads to be installed may be such as having only one head for a monochromatic ink, but, in addition, those having plural heads for plural kinds of ink of different recording colors and densities may be used. In other words, the present invention is extremely effective not only to the recording apparatus used for a main color such as black as a recording mode, for example, but also to the recording apparatus which is provided with at least one of the recording modes in a complex color having different colors in it or in a full color made by mixing colors, irrespective of the structural arrangements of the heads, whether such recording heads are integrally structured or formed by combining plural heads.

Furthermore, as a mode of the recording apparatus, the present invention is effectively applicable to a copying apparatus combined with a reader and others, in addition to those used as an image output terminal for a computer and other information processing equipment. It is also effectively applicable to the equipment which adopts a mode as a facsimile apparatus having transmitting and receiving functions.

What is claimed is:

1. A recording apparatus comprising:

a recording head member for forming an image on a recording medium;

a supporting member for holding said head member;

a first electrical connection portion provided on said head member;

a second electrical connection portion provided on said supporting member, said second electrical connection portion being configured to be electrically connectable to said first electrical connection portion; and a deelectrifying member provided for said supporting member in a vicinity of said second electrical connection portion for deelectrifying static electricity, said deelectrifying member preventing static electricity from flowing into signal lines provided for said second electrical connection portion when said head member is held in said supporting member, wherein said deelectrifying member functions as an attachment member for attaching said second electrical connection portion to said supporting member.

2. A recording apparatus for recording on a recording medium by using a recording head mounted on a carriage reciprocally moving alone the recording medium, said apparatus comprising:

a carriage side connection terminal provided on said carriage for an electrical connection between said carriage side connection terminal and a head side electrical connection terminal of said recording head when said recording head is mounted on said carriage, said carriage side connection terminal being provided on a cable member for transmitting recording information from a recording apparatus body to said recording head; and a deelectrifying member provided on said carriage in a vicinity of a connection between said head side electrical connection terminal and said carriage side connection terminal, said deelectrifying member functioning as an attachment member for attaching said cable member to said carriage.

3. A recording apparatus according to claim 2, wherein said deelectrifying member dually functions as a member for fixing said cable member to said carriage.

4. A recording apparatus according to claim 2, wherein said deelectrifying member is grounded through said cable member.

5. A recording apparatus according to claim 2, wherein said head is detachable from said recording carriage.

6. A recording apparatus according to claim 2, wherein said recording head is a head of an ink jet type for forming an image by discharging ink.

7. A recording apparatus according to claim 6, wherein said recording head is provided with elements for generating energy to be utilized for discharging ink.

8. A recording apparatus according to claim 7, wherein said elements for generating energy are electrothermal transducers for generating heat energy creating film boiling in the ink.

9. A recording apparatus having head holding means for removably holding a recording head for forming an image on a recording medium and contact means provided on said head holding means to obtain an electrical contact between an electrical contact surface of said recording head and said contact means, said apparatus comprising:

a flexible base board having a contact face made of a conductor in a position where said contact means faces the electrical contact surface of said recording head; and a deelectrifying member arranged to abut upon a conductive member provided for said recording head, said deelectrifying member functioning as an attachment member for attaching said flexible base board to said head holding means.

10. A recording apparatus according to claim 9, wherein said deelectrifying member is configured to generate a contacting pressure by resiliency thereof when said deelectrifying member abuts on said recording head.

11. A recording apparatus according to claim 9, wherein the electrical contact surface of said recording head is configured in a recessed form so that the electrical contact surface is positioned lower than a surrounding surface in a mounting direction of said recording head, and a contact surface of said contact means is configured in an extruded form corresponding in shape to the recessed form of the electrical contact surface of said recording head.

12. A recording apparatus according to claim 11, wherein a length of said deelectrifying member is greater than a depth of the electrical contact surface of said recording head.

13. A recording apparatus according to claim 9, wherein said deelectrifying member comprises a portion having different resiliency from other portions of said deelectrifying member, and an inflection point thereof is made a buckling point.

14. A recording apparatus according to claim 13, wherein said flexible base board comprises an insulating base material, a conductor, and an insulating cover material, and said deelectrifying member is of such a structure that the buckling point is at an end of said insulating cover material.

15. A recording apparatus according to claim 9, wherein a cut-off portion or a hole is provided for said deelectrifying member.

16. An apparatus according to claim 9, wherein said recording head comprises an ink jet recording head for discharging ink from a nozzle.

17. An apparatus according to claim 16, wherein said ink jet recording head discharges ink from the nozzle by utilizing thermal energy generated by an electrothermal converting element.

18. A recording apparatus having head holding means for removably holding a recording head, said recording head having an electrical contact surface and used to form an image on a recording medium, and contact means provided on said head holding means to obtain an electrical contact between said electrical contact surface of said recording head and said contact means, said apparatus comprising:

a flexible base board having a contact face made of a conductor in a position where said contact means faces the electrical contact surface of said recording head; and a deelectrifying member arranged to abut upon a conductive member provided for said recording head, said deelectrifying member functioning as a positioning member for positioning said flexible base board.

19. A recording apparatus according to claim 18, wherein said deelectrifying member is configured to generate a contacting pressure by resiliency thereof when said deelectrifying member abuts on said recording head.

20. A recording apparatus according to claim 18, wherein the electrical contact surface of said recording head is configured in a recessed form so that the electrical contact surface is positioned lower than a surrounding surface in a mounting direction of said recording head, and a contact surface of said contact means is configured in an extruded form corresponding in shape to the recessed form of the electrical contact surface of said recording head.

21. A recording apparatus according to claim 20, wherein a length of said deelectrifying member is greater than a depth of the electrical contact surface of said recording head.

22. A recording apparatus according to claim 18, wherein said deelectrifying member comprises a plurality of portions, wherein at least one portion having different resiliency from other portions of said deelectrifying member, and an inflection point thereof is made a buckling point.

23. A recording apparatus according to claim 22, wherein said flexible base board comprises an insulating base material, a conductor, and an insulating cover material, and said deelectrifying member is of such a structure that the buckling point is at an end of said insulating cover material.

24. A recording apparatus according to claim 18, wherein a cut-off portion which is provided for said deelectrifying member.

25. An apparatus according to claim 18, wherein said recording head comprises an ink jet recording head for discharging ink from a nozzle.

26. An apparatus according to claim 25, wherein said ink jet recording head discharges ink from the nozzle by utilizing thermal energy generated by an electrothermal converting element.

27. An apparatus having a head mounting member for mounting a head member provided with an electrical connecting member, said apparatus comprising:

a mounting member electrical connecting member provided on one side of said head mounting member, said mounting member electrical connecting member having planar electrical contacts;

a head moving member for causing said mounting member electrical connecting member to oppose and approach a head member electrical connecting member so that said mounting member electrical connecting member and said head member electrical connecting member are in electrical connection with each other; and a deelectrifying member provided in a vicinity of said mounting member electrical connecting member, said deelectrifying member being positioned such that, with said head member approaching said mounting member electrical connecting member, said deelectrifying member contacts said head member electrical connecting member before said electrical contacts contact said head member electrical connecting member, wherein said deelectrifying member is configured to generate a contacting pressure by resiliency thereof when said deelectrifying member abuts on said head member.

28. An apparatus according to claim 27, wherein said head member electrical connecting member is configured in a recessed form so that the electrical connecting portion is positioned lower than a surrounding surface in a mounting direction of said head member, and a contact surface of said mounting member electrical connecting member is configured in an extruded form corresponding in shape to the recessed form of said head member electrical connecting member.

29. An apparatus according to claim 28, wherein a length of said deelectrifying member is greater than a depth of said head member electrical connecting member.

30. An apparatus according to claim 27, wherein said deelectrifying member comprises a portion having different resiliency from other portions of said deelectrifying member, and an inflection point thereof is made a buckling point.

31. An apparatus according to claim 30, wherein said mounting member electrical connecting member comprises an insulating base material, a conductor, and an insulating cover material, and said deelectrifying member is of such a structure that the buckling point is at an end of said insulting cover material.

32. An apparatus according to claim 27, wherein a cut-off portion or a hole is provided for said deelectrifying member.

33. An apparatus according to claim 27, wherein said head mounting member is capable of mounting said head member.

34. An apparatus according to claim 33, wherein said head member comprises an ink jet recording head for discharging ink from a nozzle.

35. An apparatus according to claim 34, wherein said ink jet recording head discharges ink from the nozzle by utilizing thermal energy generated by an electrothermal converting element.

* * * * *

UNITED STATES PATENT AND TRADEMARK OFFICE

CERTIFICATE OF CORRECTION

PATENT NO. : 5,971,525

DATED : October 26, 1999

INVENTOR(S) : INOUE ET AL.

It is certified that error appears in the above-identified patent and that said Letters Patent is hereby corrected as shown below:

Title page, item

[30] Foreign Application Priority Data:

Line 3, "Aug. 24, 1994" should read --July 22, 1994--.

COLUMN 4:

Line 51, "is-provided" should read --is provided--.

Line 62, "a" should read --an--.

COLUMN 13:

Line 33, "sheet P." should read --sheet P is provided.--.

COLUMN 14:

Line 65, "form" should read --from--.

COLUMN 16:

Line 64, "alone" should read --along--.

COLUMN 17:

Line 20, "said head" should read --said recording head--, and "recording carriage." should read --carriage.--.

COLUMN 18:

Line 54, "which" should be deleted.

UNITED STATES PATENT AND TRADEMARK OFFICE

CERTIFICATE OF CORRECTION

PATENT NO. : 5,971,525

DATED : October 26, 1999

INVENTOR(S) : INOUE ET AL.

It is certified that error appears in the above-identified patent and that said Letters Patent is hereby corrected as shown below:

COLUMN 20:

Line 14, "insulting" should read --insulating--.

Signed and Sealed this

First Day of May, 2001

*Attest:*

Nicholas P. Godici

NICHOLAS P. GODICI

*Attesting Officer*

*Acting Director of the United States Patent and Trademark Office*